US009552911B2

(12) United States Patent
McGuire et al.

(10) Patent No.: US 9,552,911 B2
(45) Date of Patent: Jan. 24, 2017

(54) HF—CO—B ALLOYS AS PERMANENT MAGNET MATERIALS

(71) Applicant: UT-Battelle, LLC, Oak Ridge, TN (US)

(72) Inventors: Michael Alan McGuire, Knoxville, TN (US); Orlando Rios, Knoxville, TN (US); Nirmal Jeevi Ghimire, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 723 days.

(21) Appl. No.: 14/044,078

(22) Filed: Oct. 2, 2013

(65) Prior Publication Data

US 2014/0090751 A1 Apr. 3, 2014

Related U.S. Application Data

(60) Provisional application No. 61/709,217, filed on Oct. 3, 2012.

(51) Int. Cl.

| | |
|---|---|
| ***C22F 1/10*** | (2006.01) |
| ***C22C 19/07*** | (2006.01) |
| ***C22C 45/04*** | (2006.01) |
| ***H01F 1/01*** | (2006.01) |
| ***H01F 1/153*** | (2006.01) |
| ***H01F 1/047*** | (2006.01) |

(52) U.S. Cl.
CPC . *H01F 1/01* (2013.01); *C22F 1/10* (2013.01); *H01F 1/047* (2013.01); *H01F 1/15333* (2013.01); *H01F 1/15316* (2013.01)

(58) Field of Classification Search
CPC ..... C22F 1/10; C22C 19/00; C22C 19/007; C22C 19/07; C22C 45/008; C22C 45/04; H01F 10/16; H01F 10/132
See application file for complete search history.

(56) References Cited

U.S. PATENT DOCUMENTS

2013/0224067 A1* 8/2013 Sawada ..... C22C 19/07 420/439

FOREIGN PATENT DOCUMENTS

JP 2012048767 A * 3/2012

* cited by examiner

*Primary Examiner* — Jessee Roe
*Assistant Examiner* — Anthony Liang
(74) *Attorney, Agent, or Firm* — Joseph A. Marasco

(57) ABSTRACT

An alloy composition is composed essentially of $Hf_{2-X}Zr_XCo_{11}B_Y$, wherein $0<X<2$ and $0<Y\leq1.5$. Moreover, an alloy composition is composed essentially of ferromagnetic $Hf_{2-X}Zr_XCo_{11}B_Y$, wherein $0\leq X<2$ and $0<Y\leq1.5$, and has a nanoscale crystalline structure comprising at least one non-equilibrium phase. The alloys can be melt-spun with in-situ and/or ex-situ annealing to produce the nanoscale crystalline structure.

11 Claims, 30 Drawing Sheets

HF—CO—B ALLOYS AS PERMANENT MAGNET MATERIALS

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

BACKGROUND OF THE INVENTION

Good permanent magnet materials must have a large remanent magnetization, large coercive field, and high Curie temperatures. This indicates the best candidates to be rich in 3d transition metals, allowing large magnetic moments and strong magnetic interactions, and to have non-cubic crystal structures, allowing strongly anisotropic magnetic properties. The strong spin-orbit coupling associated with the 4f electrons of rare-earth elements can lead to enhanced intrinsic (magnetocrystalline) anisotropy, and the best permanent magnet materials contain rare-earths in combination with 3d transition metals. However, there is economic and scientific interest in attaining good permanent magnet properties without rare-earth elements.

AlNiCo, a well-known, conventional, non-rare-earth magnet, has relatively weak magneto-crystalline anisotropy, and attains good performance through anisotropic microstructures (shape anisotropy) developed during spinodal decomposition in an applied magnetic field.

Another high-performing, alternative material is PtCo. Strong spin-orbit coupling on Pt is important in providing magnetic anisotropy. Spin-orbit coupling is strong in all heavy elements, and combining 3d transition metals with heavier 4d/5d metals is a contemplated route to new anisotropic ferromagnets. However, the use of precious and/or semiprecious metals reduces the attractiveness of these materials.

There is a need for high performance, non-rare-earth magnetic materials that contain little or no precious and/or semiprecious metals.

In the ferromagnetic state, the coercivity or coercive field is defined as the magnetic field at which the magnetic moment of a magnetized sample is reduced to zero. If mechanisms are available with little energetic barrier to either rotate the moment within a magnetic domain, or nucleate a reversed domain and move the resulting domain wall, coercivity will be low. Such a material is referred to as a soft ferromagnet. If this is not the case, and there is high resistance to demagnetizing fields (i.e. rotating magnetic moments within a domain is energetically costly, and/or magnetic domain walls are prevented from moving freely), then the materials is referred to as a hard ferromagnet. In general, materials with coercivity ≥1000 Oe can be classified as hard ferromagnets, and are required for permanent magnets. Soft ferromagnets have lower coercivity, and good soft ferromagnets have coercivity <1 Oe, and are important for applications like transformer cores. Intermediate materials having a coercivity >1 Oe and <1000 Oe are useful in applications where a magnetic hysteresis losses are required in applications such as, for example, transformation of electromagnetic energy into thermal energy, also known as magneto-thermal conversion.

In all cases, microstructure plays a key role in magnetic performance by determining the mechanisms by which the reversal of magnetic moments occurs. As noted above, the microstructure of AlNiCo magnets results in strong anisotropy and ultimately high coercivity. In rare-earth magnets, the high intrinsic magnetocrystalline anisotropy leads to high coercivity only when proper microstructure is realized.

Melt-spinning is a commercially used process for obtaining the fine-grained microstructures required for hard ferromagnets. The rapid cooling that occurs during this process can produce kinetically stabilized microstructures far from equilibrium. Controlling the subsequent evolution by relaxation of these high energy states enables fine tuning of the microstructures.

BRIEF SUMMARY OF THE INVENTION

An alloy composition is composed essentially of $Hf_{2-X}Zr_XCo_{11}B_Y$, wherein $0<X<2$ and $0<Y\leq1.5$. Moreover, an alloy composition is composed essentially of $Hf_{2-X}Zr_XCo_{11}B_Y$, wherein $0\leq X<2$ and $0<Y\leq1.5$, and has a nanoscale crystalline structure comprising at least one non-equilibrium phase. The alloys can be melt-spun with in-situ and/or ex-situ annealing to produce the nanoscale crystalline structure. In-situ annealing is defined as the crystallization to form a metastable nanoscale crystalline structure, upon cooling from the liquid state that occurs during the melt-spinning operation. Ex-situ annealing is defined as re-heating the amorphous, partially crystalline, or crystalline material after completion of the melt-spinning operation.

Figure 1:
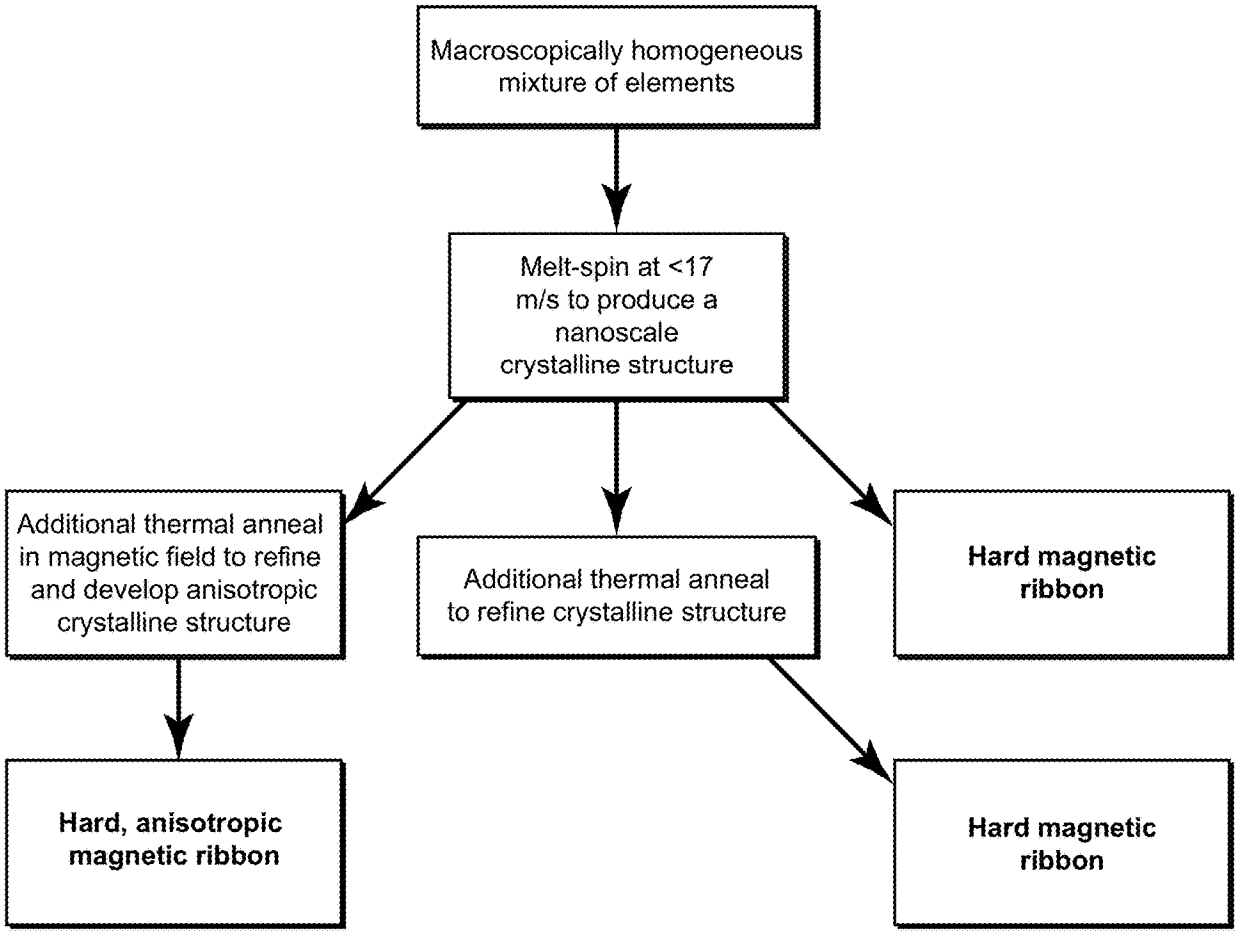
FIG. 1 is a flowchart showing various methods involving melt-spinning a $Hf_2Co_{11}B$ alloy at a relatively low wheel speed corresponding to surface velocity <17 m/s to form nanocrystalline, hard magnetic ribbons.

For a better understanding of the present invention, together with other and further objects, advantages and capabilities thereof, reference is made to the following disclosure and appended claims in connection with the above-described drawings.

DETAILED DESCRIPTION OF THE INVENTION

Melt-spun $Hf_2Co_{11}B$ exhibits ferromagnetism below 770 K in both amorphous and crystalline samples. The far from equilibrium melt spinning process is used to produce a unique composition of matter that is comprised of metastable phases that do not form via conventional melt processing routes such as arc melting, induction melting, melting in a crucible or other comparable methods. Material that crystallized during melt-spinning exhibited hard magnetic behavior, with intrinsic coercive fields near 4.5 kOe. A maximum energy product ($BH_{max}$) of 6.7 MGOe was obtained in this rare-earth-free material, which is as high as most grades of AlNiCo, and only about a factor of two lower than $BH_{max}$ for the best melt-spun ribbons of $Nd_2Fe_{14}B$. These findings indicate $Hf_2Co_{11}B$ to be a competitive candidate for non-rare-earth permanent magnets.

Advanced control of the magnetic properties, specifically the magnetic energy product, are a result of the tunable crystallization kinetics of magnetically responsive phases out of the metastable amorphous phase. Beneficial effects are enabled by tailoring the morphological evolution of a magnetically responsive crystalline phases in order to obtain a distribution of nanoscale precipitates (nanoscale crystalline structure) that is optimal for applications that require either a high energy product (hard magnetism), low magnetic hysteresis losses (soft magnetism), or intermediates thereof.

The terms "nanoscale crystalline structure" and "nanocrystalline" are used herein to describe a material that is composed mainly of a distribution of discrete crystals that have diameters in the nanometer range, having an average particle size of no more than 2 μm. The discrete crystals are referred to herein as nanoscale precipitates. A nanoscale crystalline structure includes at least one non-equilibrium phase which is a kinetically stabilized composition of matter also know as a frozen metastable structure. Herein metastable structures are defined as compositions that do not form under equilibrium solidification and have morphologies and/or crystal structure which are not thermodynamically stable. In the description of this invention equilibrium solidification is defined as cooling rates less than 500 K/s typical in arc, induction, resistance or convection melt processing or casting. Although the nanoscale crystalline structure is metastable, it will persist to exist in the absence of thermal excitations below a threshold activation energy.

Using the methods taught herein it is possible to produce materials having tunable magnetic properties such as coercivity and remanent moment. Coercivity measurements are used to categorize materials as magnetically soft or magnetically hard as described above. Through the combination of material composition and thermal processing it is possible to obtain materials in either category. Both processing time and temperature have been varied.

A general method can include several variable steps. The component elements are melted in a nonreactive environment to form an essentially, macroscopically homogeneous, mixture of elements—the master alloy. Conventional arc melting was used with success. The skilled artisan will recognize that various conventional melting methods can be employed to homogenously mix components without departing from the scope of the invention such as, for example, induction, resistive, and/or convection. The melted alloy can be cooled to form an ingot, also known as a button and/or a slug. The initial melt can be directly melt-spun without cooling to form the slug and re-melting.

The melt or ingot is melt-spun to rapidly cool and solidify the alloy to form a ribbon. As will be set forth hereinbelow, proper selection of various wheel speeds and annealing conditions are critical to obtaining desired microstructure in the ribbon. Desired microstructures that impart the required magnetic properties can be achieved by melt-spinning in a way which directly produces a material having a nanoscale crystalline structure, or by post-annealing of amorphous melt-spun ribbons to precipitate a nanoscale crystalline structure. By controlling the microstructural evolution during melt spinning and/or post annealing it is possible to tailor the magnetic properties between fully amorphous magnetically soft materials or highly crystalline magnetically hard materials, along with hybrid microstructures that lie in-between fully hard and soft magnetic materials. Subsequent post-annealing of as-spun materials can be used to coarsen crystalline phases, smooth grain boundaries or transform retained amorphous regions within the ribbon. Various methods have been successfully employed and are described herein below.

During the melt-spinning process, the solidification rate is controlled to kinetically suppress the formation of equilibrium phases while maintaining sufficient thermal energy to enable nucleation of metastable crystallites. The development of far from equilibrium ordered regions in the form of nanoscale crystallites that either form during melt spinning or precipitate out from the amorphous phase are linked to the large coercivity. The cooling rate that occurs during the melt-spinning process is difficult to determine, but depends strongly on the speed at which the wheel is spinning. Wheel speed can be accurately be monitored and controlled and therefore the current state of the art melt spinning processing methods monitor wheel speed to control cooling rates.

The examples described herein were made using a 30 cm diameter solid copper wheel of thickness 1.2 cm, and reference cooling rates in terms of the corresponding wheel speed as defined by the surface velocity at the rim of the wheel. The wheel speeds employed in this invention are expected to be in the range between $3\times10^4$ and $8\times10^6$ K/s however, there is no discernible upper limit to forming amorphous phases from molten metals. The cooling rates during melt spinning are also a function of the process gas and chamber pressure.

The skilled artisan will recognize that various combinations of wheel temperature, wheel speed, non-reacting process gas and chamber pressure will achieve comparable cooling rates without departing from the scope of the invention. In examples of the present invention, wheel temperature (nominally room temperature), process gas (>99 wt % Argon) and chamber pressure (nominally ambient) were held constant, therefore to simplify discussion, only the wheel speed is discussed in reference to this invention.

Referring to FIG. 1, melt-spinning the alloy at a relatively low wheel speed of <17 m/s produces an alloy that is essentially crystalline, having a nanoscale crystalline structure that results in values of coercivity greater than 4 kOe.

Additional thermal annealing consist of heating the melt spun magnetically hard materials to above 250° C. and below the crystallization temperature for equilibrium phases (observed at approximately 550° C.). The thermal treatment can be employed to produce a further optimized nanoscale-crystalline structure resulting in enhanced energy products. Annealing can reduce any remaining amorphous material and smooth grain boundaries which will lead to increased coercivity as occurs in NdFeB magnets.

Figure 2:
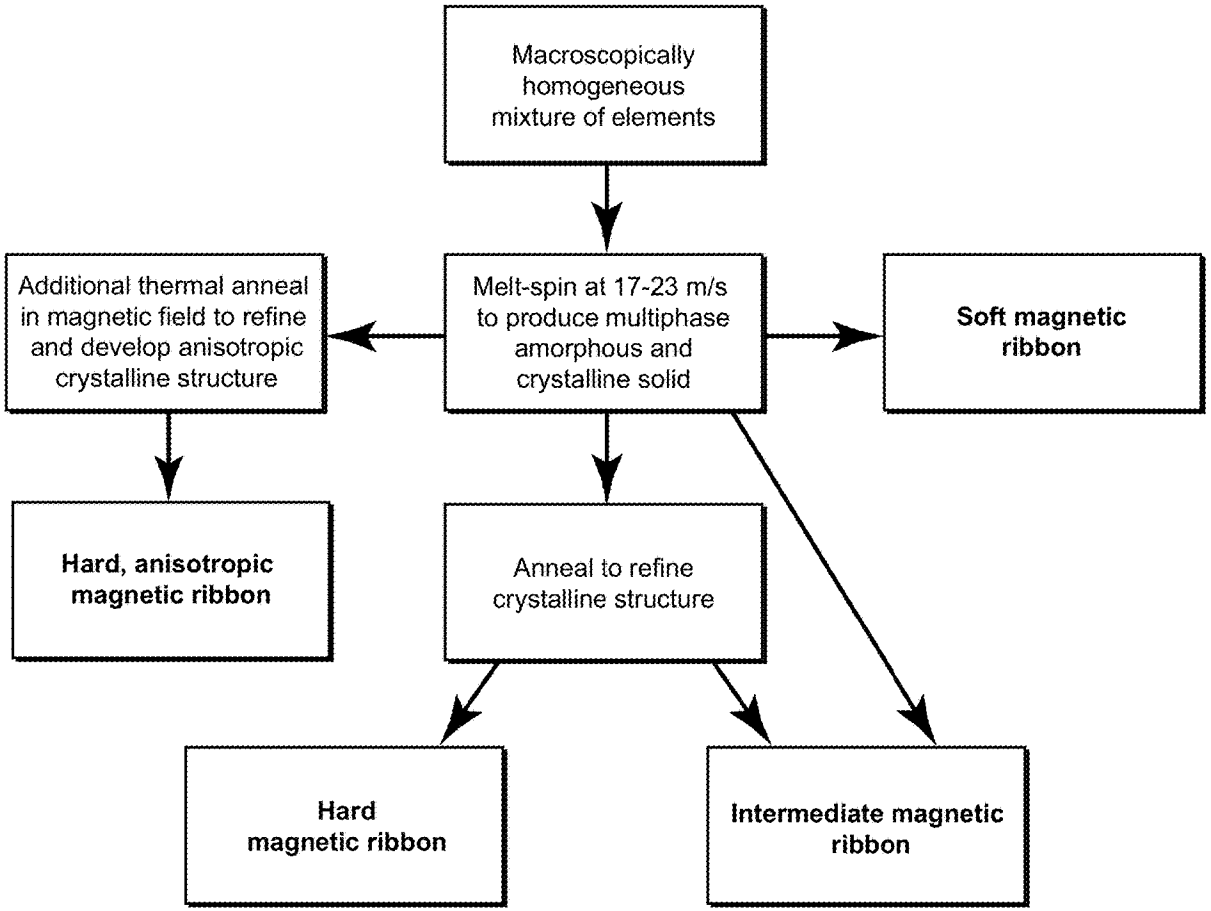
FIG. 2 is a flowchart showing various methods involving melt-spinning a $Hf_2Co_{11}B$ alloy at an intermediate wheel speed corresponding to surface velocity in the range of 17 to 23 m/s to form multiphase amorphous and nanocrystalline, ribbons having intermediate coercivity.

Referring to FIG. 2, melt-spinning the alloy at an intermediate wheel speed corresponding to a surface velocity in the range of 17 to 23 m/s produces an alloy that is partially crystalline and partially amorphous. Subsequent thermal annealing of this melt-spun material can be employed to refine the magnetic and microstructural properties as described in the previous paragraph.

Figure 3:
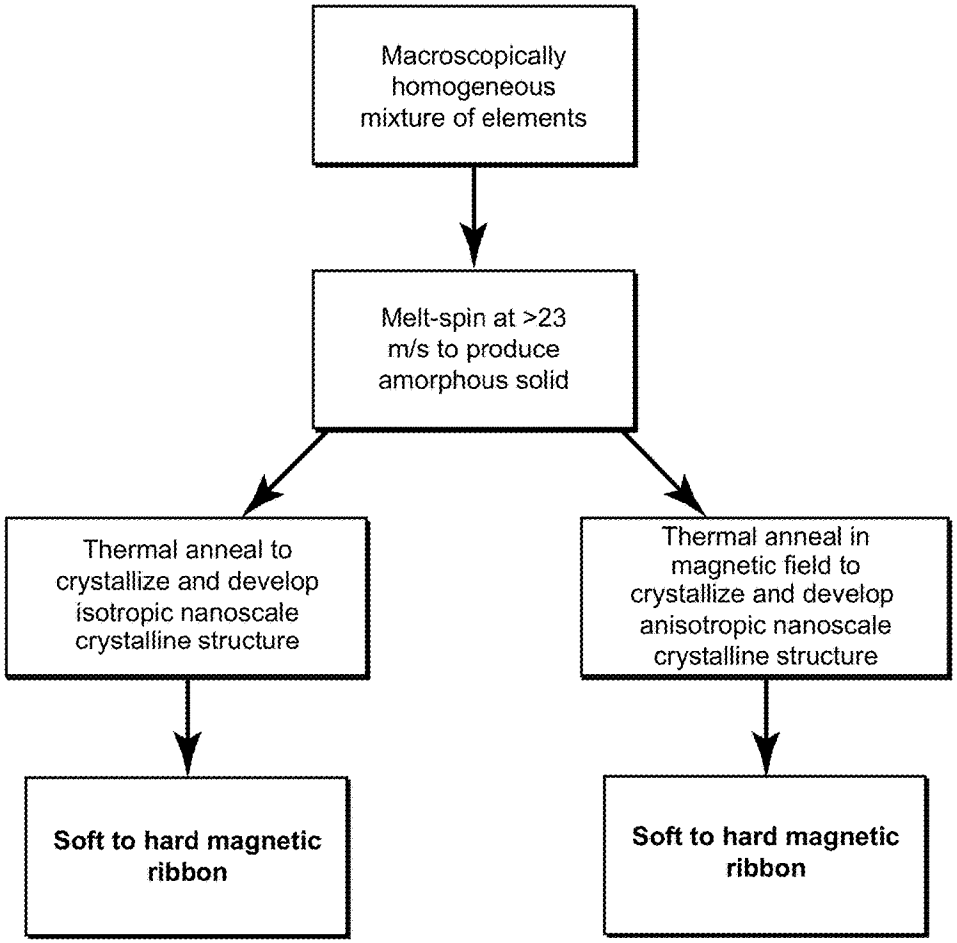
FIG. 3 is a flowchart showing various methods involving melt-spinning a $Hf_2Co_{11}B$ alloy at a relatively high wheel speed corresponding to surface velocity >23 m/s to form amorphous, soft magnetic ribbons.

Referring to FIG. 3, melt-spinning the alloy at a relatively high wheel speed corresponding to a surface velocity of >23 m/s produces an essentially amorphous alloy. This amorphous alloy is magnetically soft, having coercivity less than 10 Oe. Thermal annealing at temperatures of 500-800° C. for times varying from 5 minutes at the highest temperatures to one week a the lowest temperatures can be employed to transform the amorphous material into a nanoscale crystalline structure through nucleation and grain growth, imparting harder magnetic properties with coercivities ≥1.5 kOe therein.

Moreover, any of the melt-spun materials described herein can be subjected to additional thermal heat-treatment, at the temperature ranges described herein, within a magnetic field of, for example, at least 1 Tesla, at least 2 Tesla, at least 3 Tesla, at least 4 Tesla, at least 5 Tesla, at least 6 Tesla, at least 7 Tesla, at least 8 Tesla, or at least 9 Tesla. Such treatments can be employed to form an at least partially anisotropic microstructure that results in enhanced energy products in specific directions that are correlated to the melt spun ribbons direction within the magnetic field. Alignment of the microstructure is expected to result in increased coercivity in the range of 5-40% vs. isotropic microstructures obtained by similar heat-treatments with no external fields.

EXAMPLE I

Alloys of composition $Hf_2Co_{11}B$ were made from cobalt slugs (99.95%), hafnium pieces (99.9% excluding Zr, nominal 2% Zr), and boron pieces (99.5%) by arc-melted under argon. The resulting slugs were inverted and remelted several times, and had a total mass of approximately 5 g each. The density of the alloy was determined to be 10.7 g/cm$^3$ from the measured mass and dimensions of a cylindrical, suction-cast rod. Melt-spinning was conducted by induction heating the samples to above the melting temperatures ($T_{melt}\approx1500$ K) in silica crucibles and ejecting them through a 0.5 mm orifice onto a 30 cm diameter, 1.2 cm thick copper wheel spinning at 1000 or 1500 rpm (16 or 24 m/s velocity at the surface). The ribbons spun at 16 m/s were on average 43 microns thick and 0.8 mm wide. The ribbons spun at 24 m/s were on average 28 microns thick and 0.4 mm wide. The side contacting the wheel was duller in appearance than the shiny, free-side.

Near room temperature magnetization measurements were conducted with the field along the length of the thin ribbons, so demagnetization effects are neglected in the analysis. X-ray diffraction (XRD) patterns were collected using Cu Kα radiation.

Processing conditions for melt-spun samples of $Hf_2Co_{11}B$ described herein and resulting magnetic properties measured at 300 K are presented in Table I. The magnetic induction B is given by $B[G]=4\pi M[emu/cm^3]+H[Oe]$.

TABLE I

| Sample Name | Wheel Speed (m/s) | M (6 T) (emu/g) | Mr (emu/g) | Br (kG) | iHc (kOe) | BHc (kOe) | BHmax (MG Oe) |
|---|---|---|---|---|---|---|---|
| ms24 | 24 | 59 | 8.1 | 1.1 | <0.01 | <0.01 | — |
| ms16-soft | 16 | 60 | 29 | 3.8 | ~0.15 | ~0.15 | ~0.1 |
| ms16-hard | 16 | 72 | 46 | 6.2 | 4.5 | 3.6 | 6.7 |

Figure 4:
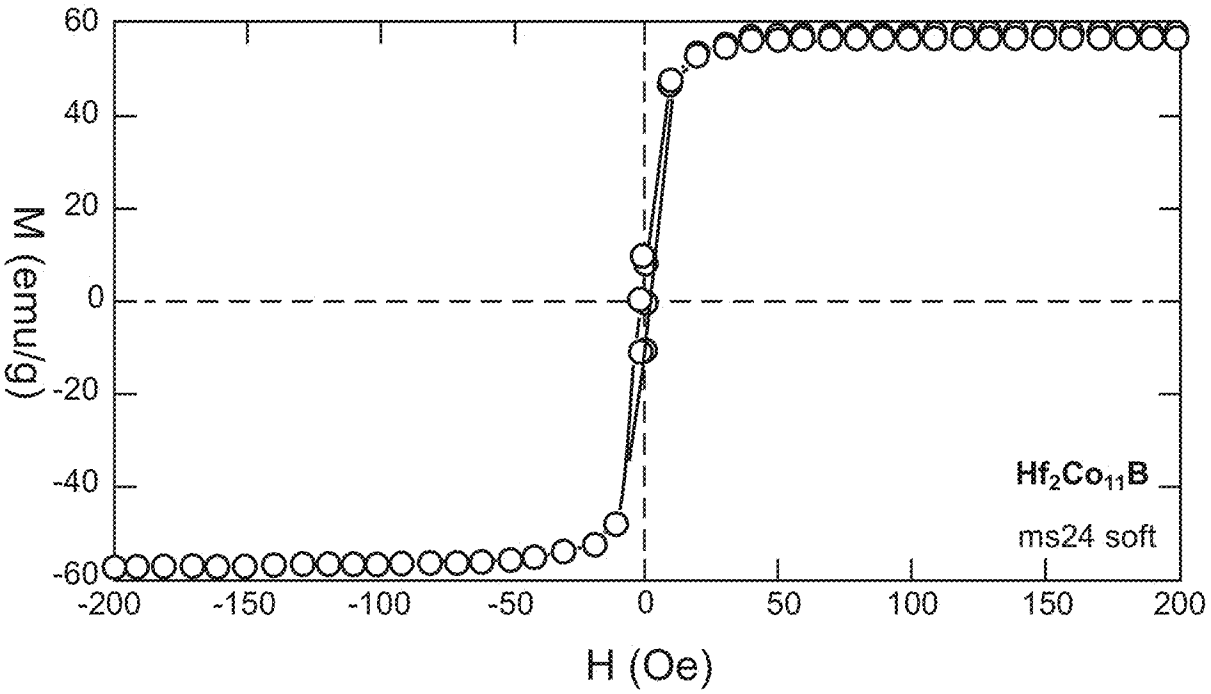
FIG. 4 is a graph showing a magnetic hysteresis loop measured at 300 K for an amorphous $Hf_2Co_{11}B$ ribbon exhibiting a soft magnetic response.
Figure 5:
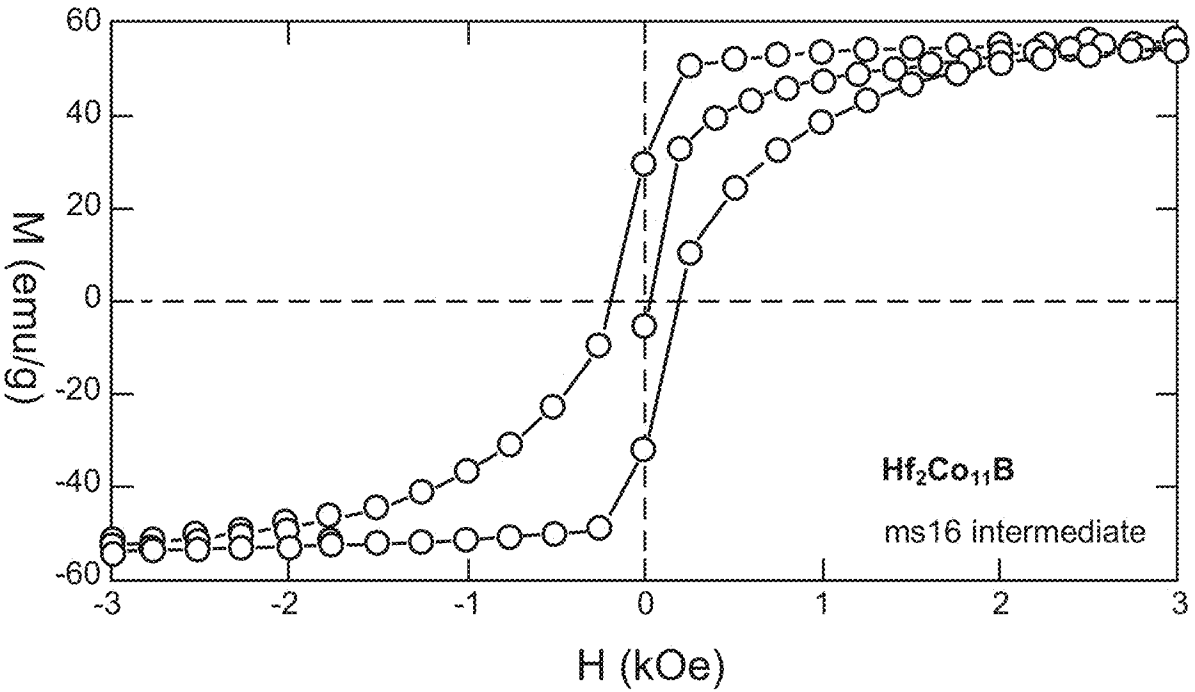
FIG. 5 is a graph showing a magnetic hysteresis loop measured at 300 K for a crystalline and amorphous duplex structured magnetically intermediate $Hf_2Co_{11}B$ ribbon.
Figure 6:
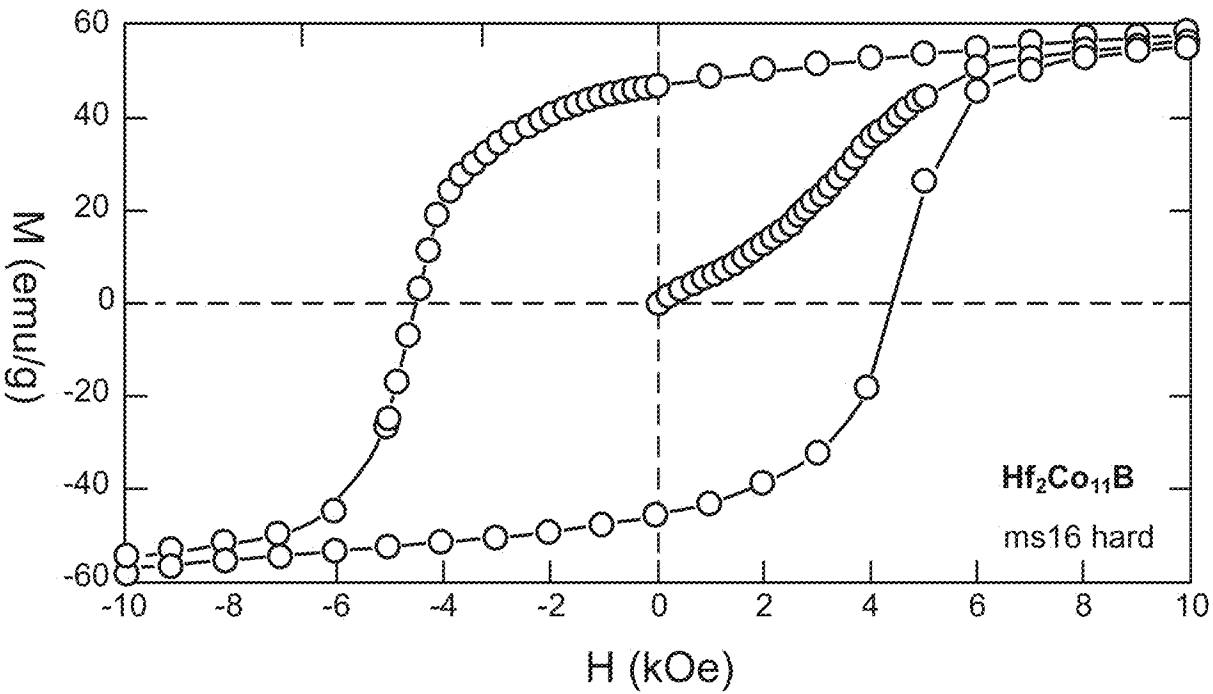
FIG. 6 is a graph showing a magnetic hysteresis loop measured at 300 K for a crystalline magnetically hard $Hf_2Co_{11}B$ ribbon.

Magnetic hysteresis loops from the as-spun ribbons measured at 300 K are shown in FIGS. 3-5. Relevant parameters determined from these measurements are collected in Table I. The materials melt-spun at 24 m/s (labeled ms24, FIG. 4) shows very soft ferromagnetism, with a coercive field of less than 10 Oe. The ribbons spun at the lower wheel speed of 16 m/s behaved quite differently, and displayed two types of behavior. Some samples are relatively soft with hysteresis loop shapes which suggest a mixture of hard and soft material. An example of this behavior is shown in FIG. 5 in the sample labeled ms16-soft. Other pieces displayed hard behavior with remanent magnetizations $M_r$>4 kOe. An example labeled ms16-hard is shown in FIG. 6. As further discussed below, the two behaviors are likely due to a variation in quenching rates during melt-spinning.

Figure 7:
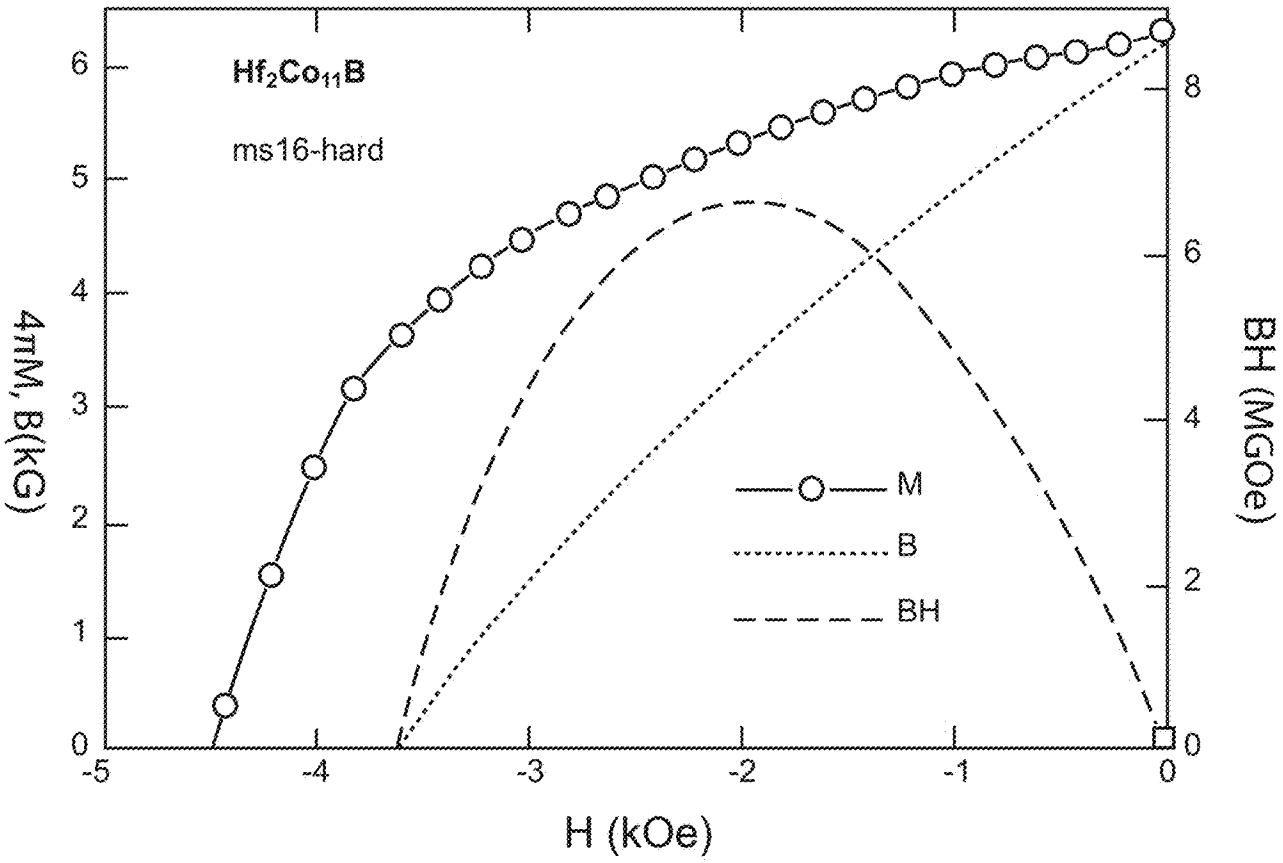
FIG. 7 is a graph showing a demagnetization curve for a hard $Hf_2Co_{11}B$ ribbon at room temperature, showing magnetization M, magnetic induction B, and the energy product BH reaching a maximum of 6.7 MGOe.

The demagnetization curve of ms16-hard is analyzed in FIG. 7. In addition to the magnetization M, the magnetic induction B and the calculated energy product BH is shown. From these curves, the coercivities ${}_iH_c$=4.5 kOe and ${}_BH_c$=3.6 kOe are identified. The energy product reaches a maximum of 6.7 MGOe at H=−2.0 kOe. Although this value is only about ⅛ the value of the best known high energy product, sintered rare-earth magnets, it is more appropriate to compare the results obtained here to those from optimized high energy product melt-spun ribbons of rare-earth magnets, which reach $BH_{max}$=14 MGOe. $Hf_2Co_{11}B$ ribbons made in accordance with the present invention reach approximately half this value. Importantly, the Curie temperature of the present materials (500° C.) is approximately 150° C. higher than that of NdFeB magnets (350° C.), enabling useful properties to be maintained at higher temperatures. In addition, $BH_{max}$=6.7 MGOe is larger than the energy products obtained in hard ferrites and is comparable to most grades AlNiCo, making $Hf_2Co_{11}B$ a relevant candidate for rare-earth free magnets.

Figure 8:
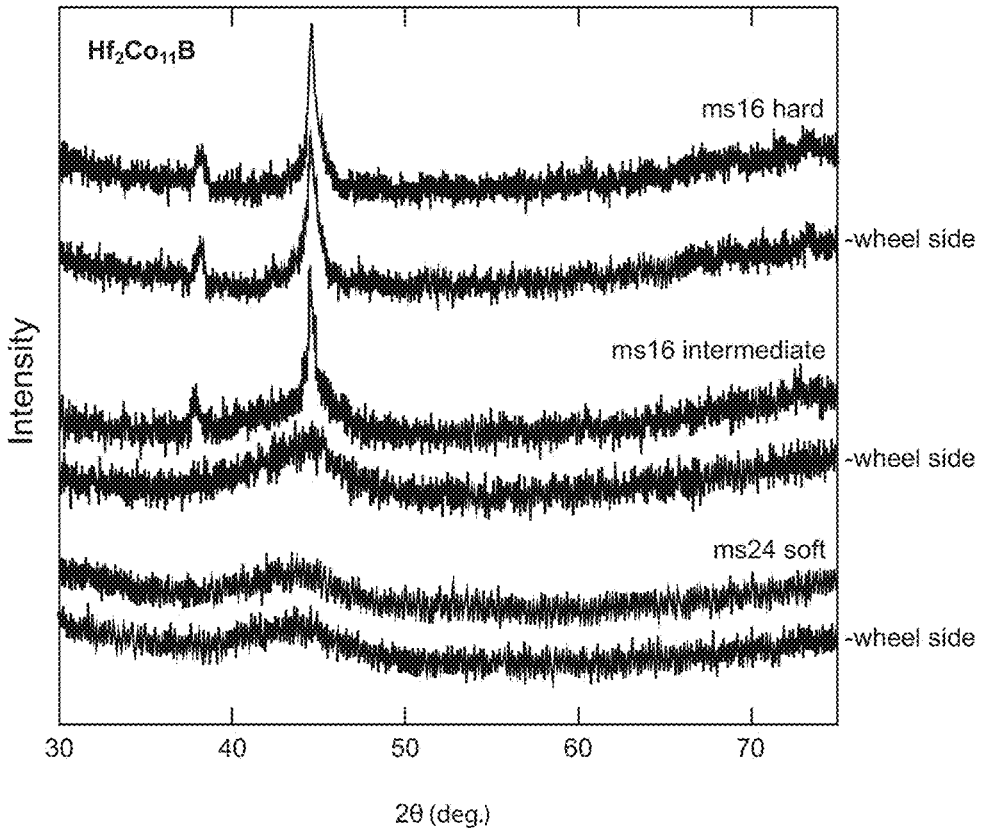
FIG. 8 is a graph showing X-ray diffraction patterns collected at room temperature from $Hf_2Co_{11}B$ ribbons.

X-ray diffraction (XRD) patterns from the two surfaces of the ribbons (free-side and wheel-side) are shown in FIG. 8. Two curves are shown for each sample to reveal crystal structure and the microstructural evolution of ordered phases. The upper curves are from the shinier, free side of the ribbons. The lower curves are from the duller side which contacted the wheel. The XRD patterns indicate that the sample which was melt-spun at 24 m/s is amorphous. Magnetically soft samples from ms16 are shown to be amorphous on the side which contacted the wheel, and contain both a crystalline and an amorphous component on the free side. Both sides of the magnetically hard samples of ms16 are crystalline and show very similar patterns with no broad feature associated with an amorphous component. The diffraction patterns shown in FIG. 8 for ms16-hard are similar to those reported for related $Zr_2Co_{11}$-based materials, where the main peaks are usually attributed a hypothetical $ZrCo_5$-like phase. In the Hf alloys, the main diffraction peaks occur at 2.36 and 2.03 Å. The complex nature of the Hf—Co phase diagram, the expected complex crystal structure of $Hf_2Co_{11}B$ and the weak diffraction from the ribbons preclude extraction of crystallographic information from the powder diffraction data. The most useful information is the related to the crystalline vs. amorphous nature of the ribbons. Since amorphous ferromagnets are expected to be magnetically soft, the diffraction results are consistent with the measured magnetization loops in FIGS. 4-6.

Figure 9:
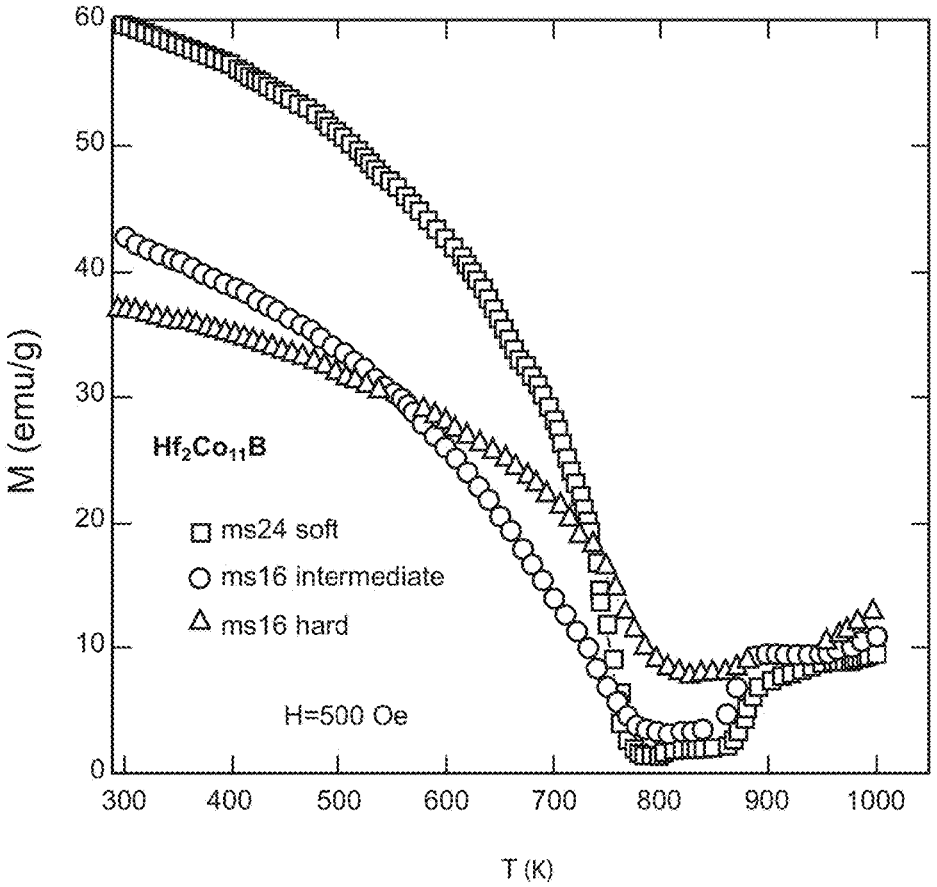
FIG. 9 is a graph showing temperature dependence of the magnetization M above room temperature for soft, intermediate, and hard $Hf_2Co_{11}B$ ribbons.

Data from high-temperature magnetization measurements on the $Hf_2Co_{11}B$ ribbons collected on warming in an applied field of 500 Oe are shown in FIG. 9. The Curie temperature $T_C$ is determined to be near 770 K in all three samples. In addition to the ferromagnetic transition, two other step-like anomalies are observed in ms24 and ms16-soft.

Figure 10:
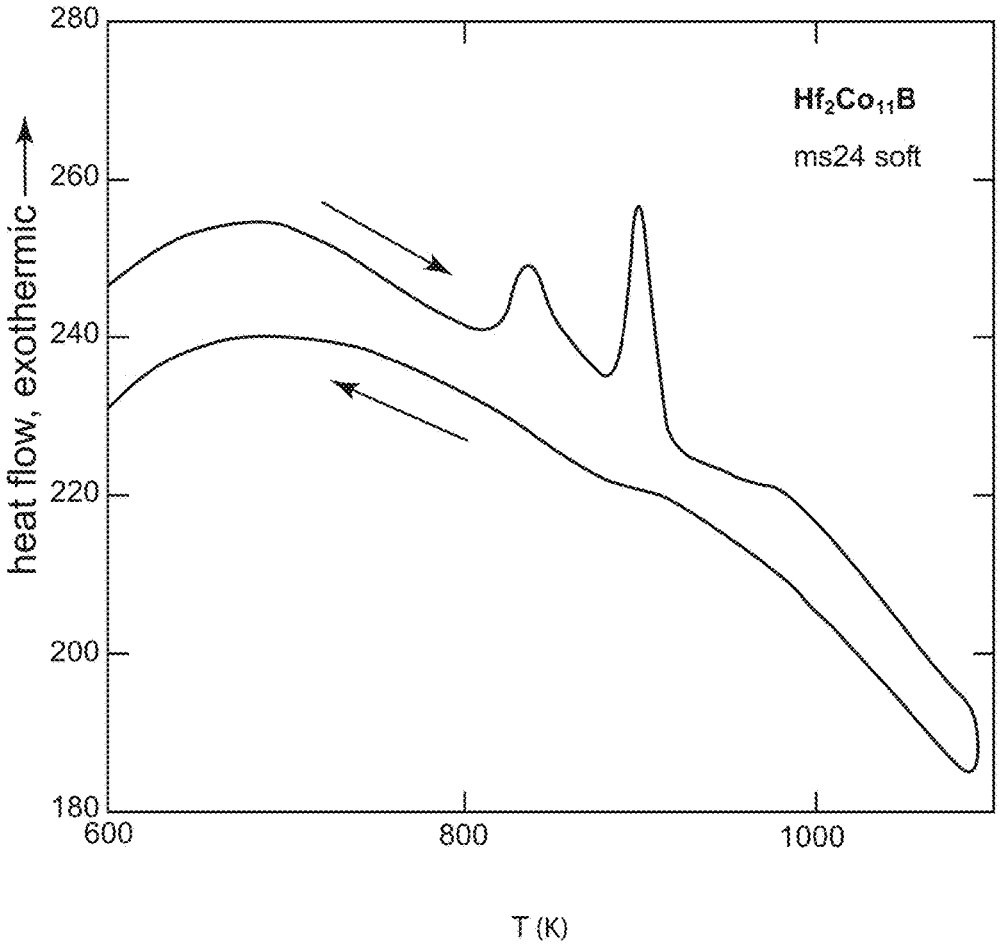
FIG. 10 is a graph showing the measured heat flow from differential thermal analysis of amorphous $Hf_2Co_{11}B$ (ms24).

Differential thermal analysis, shown in FIG. 10, indicates anomalies these to be irreversible, exothermic phase transitions. These are identified as crystallization of the amorphous component, followed by decomposition of a metastable phase. Data shown in FIG. 10 were collected with a heating/cooling rate of 5 K/min on a 25 mg sample. Exothermic peaks in the thermal analysis on warming and step-like features in the magnetization data between 800 and 900 K indicate two irreversible phase transformations occur in this temperature range. The irreversible nature of the transitions is supported by magnetization measured on cooling (not shown). These features are suppressed in the magnetically hard material, indicating that a significant amount of crystallization/phase transformation occurred during melt-spinning. At the highest temperatures, there is a relatively large magnetic moment in all materials, suggesting cobalt metal ($T_C$=1400 K) is precipitated at high temperatures. The data indicates that the ms16-hard may contain some free Co metal as-spun, since the magnetization is less strongly suppressed just above the transition at 770 K.

Figure 11:
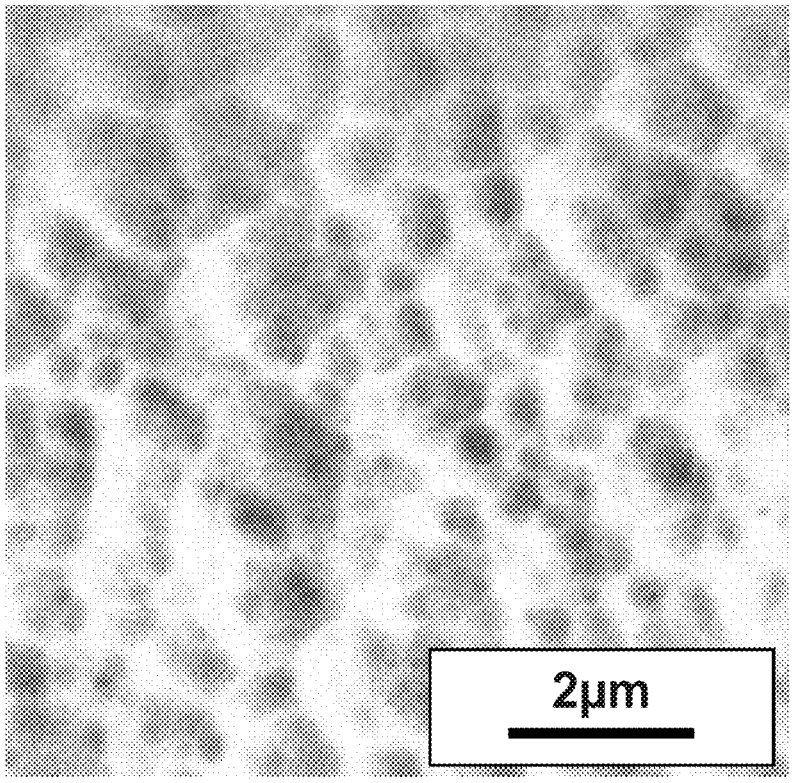
FIG. 11 is a backscattered SEM electron micrograph image showing amorphous, soft magnetic $Hf_2Co_{11}B$ ribbon.
Figure 12:
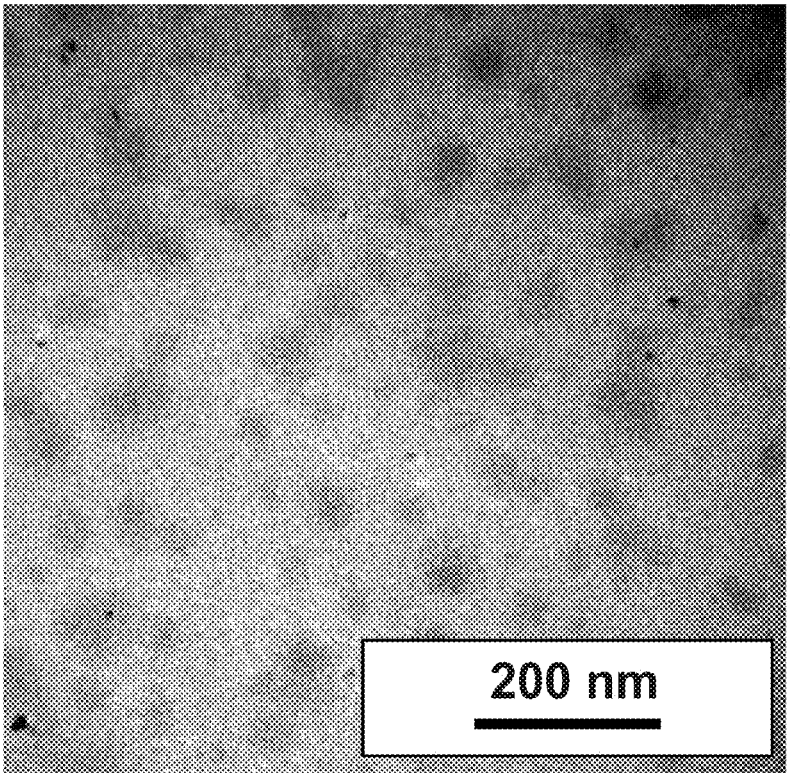
FIG. 12 is a bright-field TEM electron micrograph image showing amorphous, soft magnetic $Hf_2Co_{11}B$ ribbon.
Figure 13:
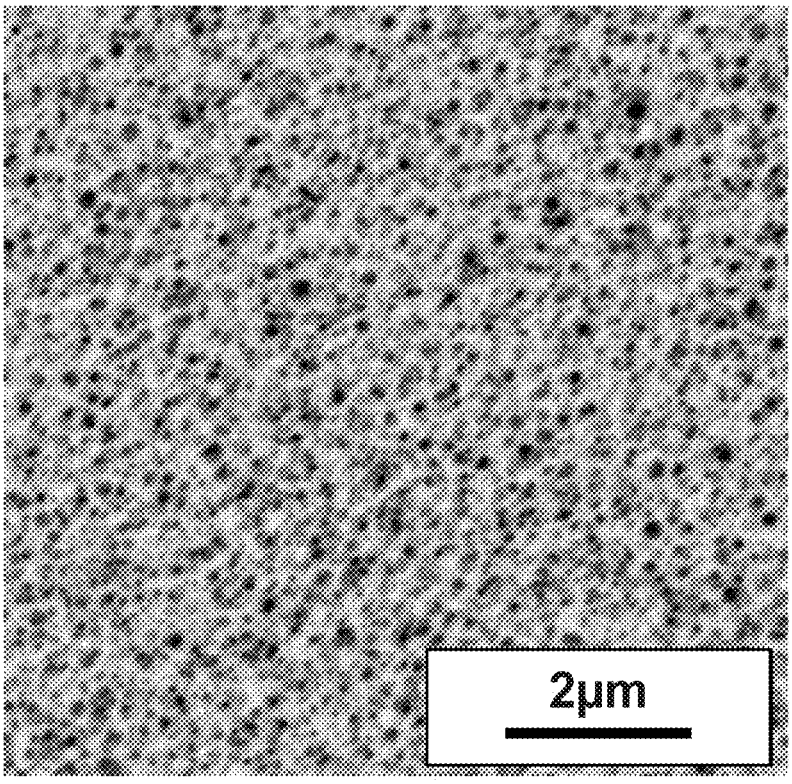
FIG. 13 is a backscattered SEM electron micrograph image showing multiphase crystalline and amorphous structured, magnetically intermediate $Hf_2Co_{11}B$ ribbon.
Figure 14:
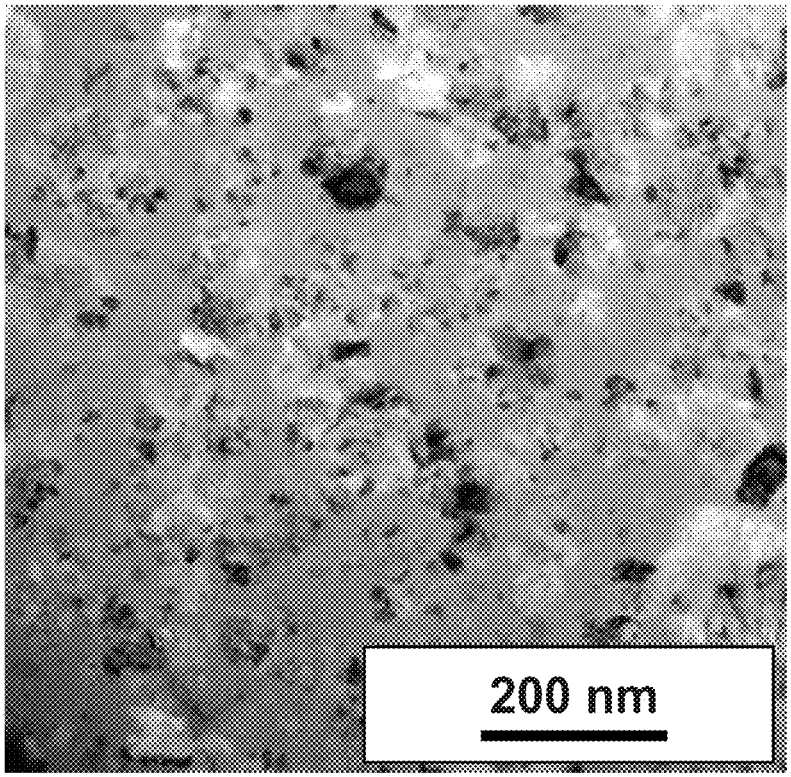
FIG. 14 is a bright-field TEM electron micrograph image showing multiphase crystalline and amorphous structured, magnetically intermediate $Hf_2Co_{11}B$ ribbon.
Figure 15:
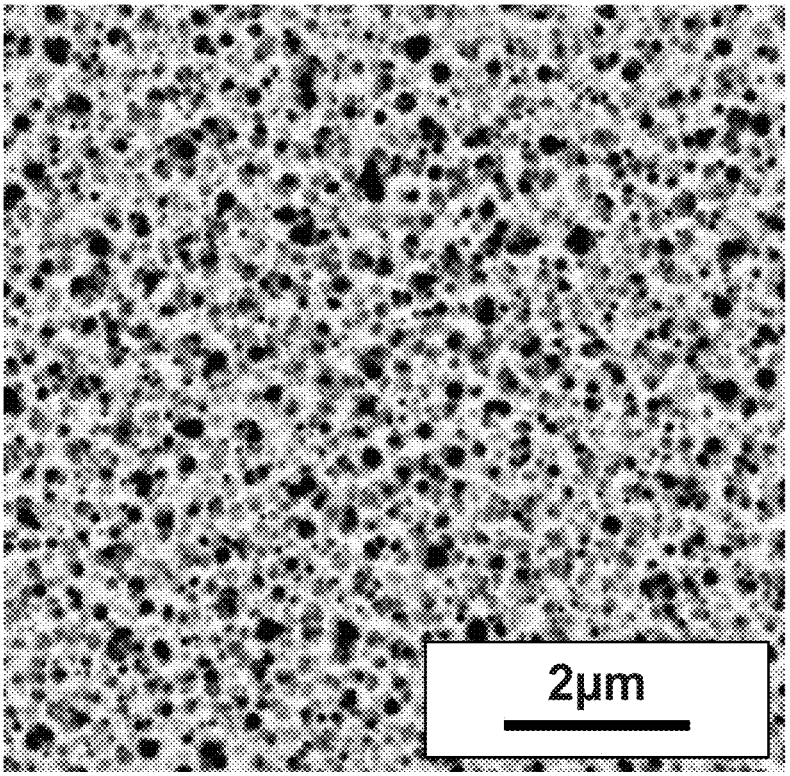
FIG. 15 is a backscattered SEM electron micrograph image showing crystalline magnetically hard $Hf_2Co_{11}B$ ribbon.
Figure 16:
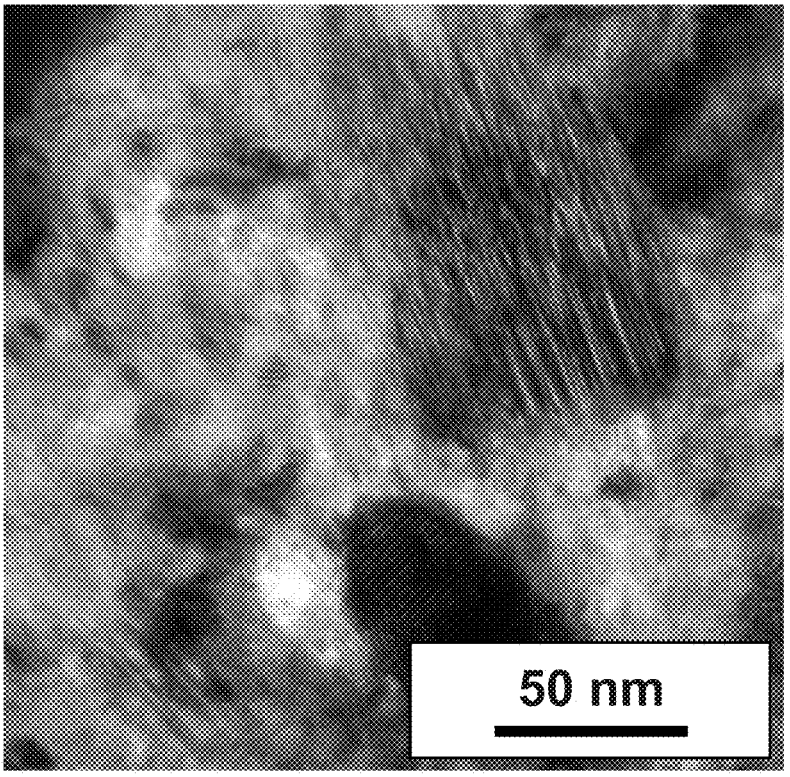
FIG. 16 is a bright-field TEM electron micrograph image showing crystalline magnetically hard $Hf_2Co_{11}B$ ribbon.

Images from scanning and transmission electron microscopy (SEM and TEM) studies of the microstructure of the $Hf_2Co_{11}B$ ribbons are shown in FIGS. 11-19. The compositional contrast in SEM images is enhanced by chemical etching that preferentially attacks the cobalt rich regions. FIGS. 11, 13, and 15 are backscattered SEM electron micrograph images of, respectively amorphous, magnetically soft, and magnetically hard $Hf_2Co_{11}B$ ribbons. FIGS. 12, 14, and 16 are bright-field TEM electron micrograph images of, respectively amorphous, magnetically soft, and magnetically hard $Hf_2Co_{11}B$ ribbons.

Figure 17:
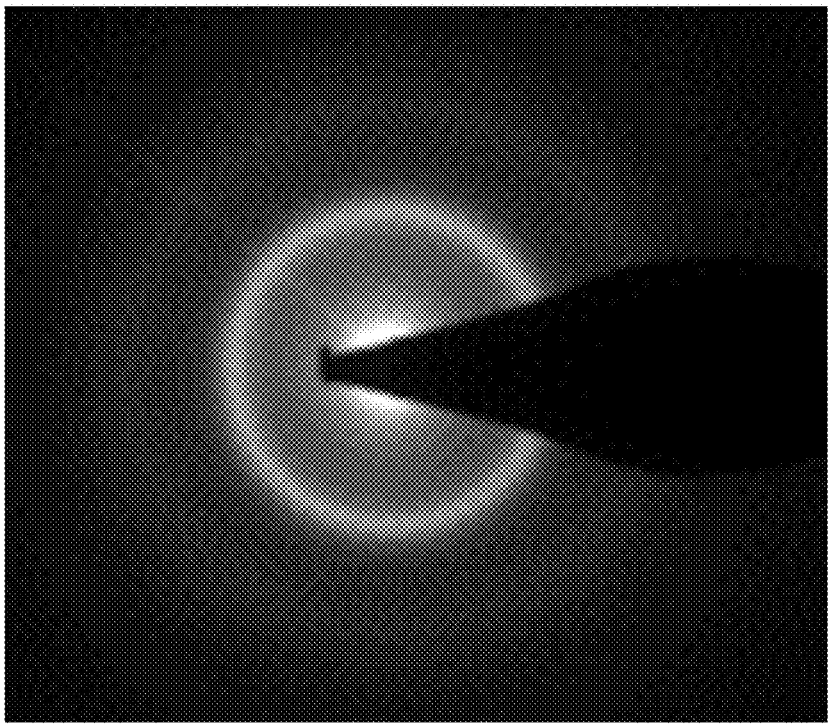
FIG. 17 is an electron diffraction pattern of a selected area of the $Hf_2Co_{11}B$ ribbon shown in FIG. 12.
Figure 18:
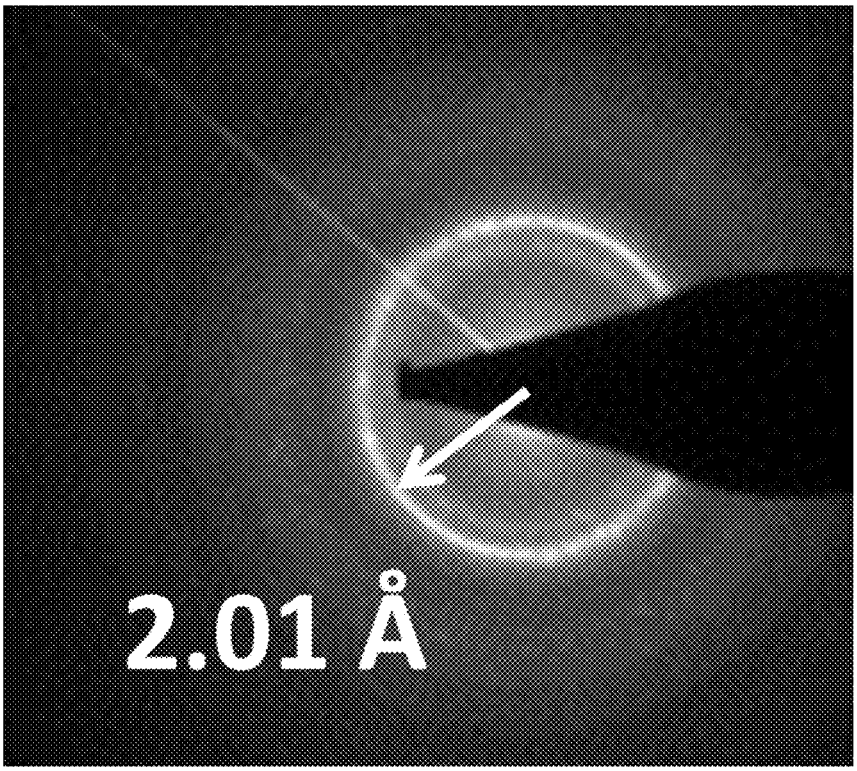
FIG. 18 is an electron diffraction pattern of a selected area (nanoscale precipitate) of the $Hf_2Co_{11}B$ ribbon shown in FIG. 14.
Figure 19:
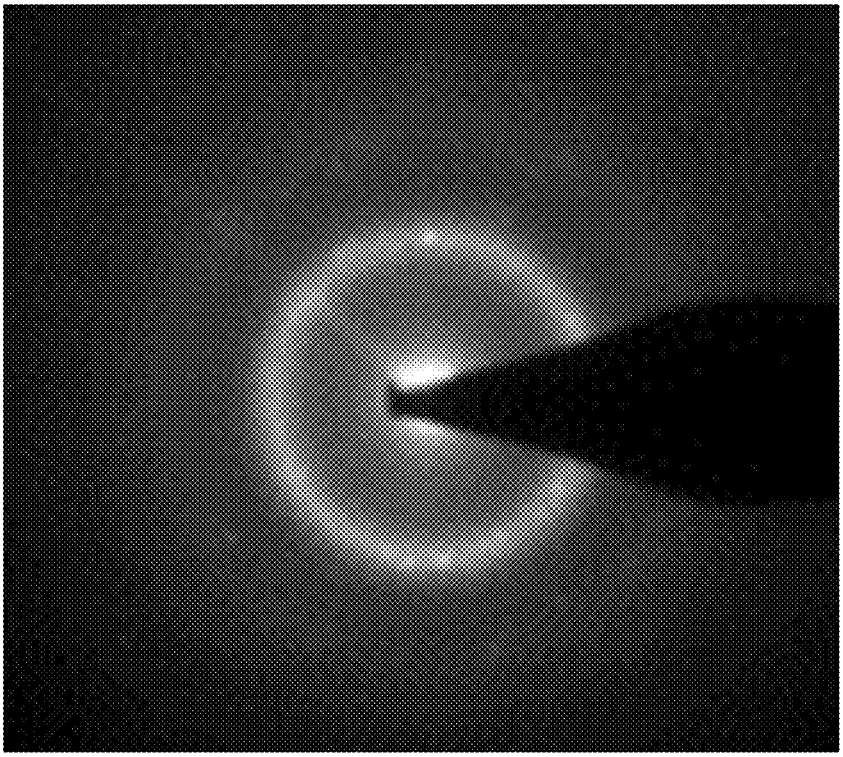
FIG. 19 is an electron diffraction pattern of a selected area of the $Hf_2Co_{11}B$ ribbon shown in FIG. 16.

FIGS. 17, 18, and 19 are electron diffraction pattern of a selected area of respective $Hf_2Co_{11}B$ ribbons shown in FIGS. 12, 14, and 16. The diffuse ring pattern shown in FIG. 17 indicates an amorphous phase and is correlated to the broad peak observed in XRD shown in FIG. 8. The convoluted diffuse and sharp rings shown in FIG. 18 indicate a multiphase structure with no preferential orientation or crystallographic texture. This SAD diffraction pattern is correlated to the sharp peak with extended edges observed in XRD shown in FIG. 8. The sharp rings shown in FIG. 19 indicate a multiphase crystalline structure with no preferential orientation or crystallographic texture. This SAD diffraction pattern is correlated to the sharp peak observed in XRD shown in FIG. 8.

The selected area electron diffraction patterns shown in FIGS. 17, 18, and 19 are consistent with the x-ray diffraction results shown in FIG. 8: the brightest ring occurs near 2.01 Å and a diffuse ring in ms-24 confirms this material is essentially amorphous. However, some compositional modulation in this material is evident both the TEM and SEM images described hereinabove. The morphology is consistent with a miscibility gap that develops in the liquid at large undercooling resulting in a spinodal decomposition. The SEM images from the other samples reveal a fine-grained, two-phase mixture, consisting of dark precipitates (Co richer) in a lighter matrix (Hf richer), consistent with results of energy dispersive spectroscopy measurements in TEM.

Selected area electron diffraction patterns taken from 150 nm regions indicated an amorphous matrix (evident in the diffuse ring) and nanoscale precipitates (sharp diffraction spots). Importantly, magnetization measurements presented in FIGS. 4-7 and 9-10 suggest that both the amorphous matrix and crystalline precipitates are ferromagnetic.

Typical sizes of the primary precipitates are 100 nm in the magnetically softer material (FIG. 13) and 140 nm in the magnetically hard material (FIG. 15). Secondary, smaller (<10 nm) particles are present in both ms16-soft and ms16-hard, but are much more prevalent in the magnetically hard material. Nano-diffraction indicated the crystalline precipitates of various sizes have large unit cells and are likely to be the same phase. The larger precipitates form a semi-continuous network with a length scale strongly correlated to the compositional modulation observed in the melt-spun amorphous material (FIGS. 12, 14). Microstructural analysis indicates the larger precipitates form first during melt-spinning in the Co rich regions while the secondary precipitation reaction is kinetically more sluggish resulting in a nanoscale crystalline structure. The increased concentration of smaller particles in the magnetically hard material suggests their presence, and the corresponding decreased volume fraction of amorphous material, may be responsible for the enhanced magnetic properties.

It is thus shown that unexpectedly hard ferromagnetic properties can be achieved in melt-spun ribbons of rare-earth-free $Hf_2Co_{11}B$ with a Curie temperature near 770 K and an energy product at room temperature of 6.7 MGOe, approximately half that of optimized $Nd_2Fe_{14}B$ ribbons. The microstructure comprises small ferromagnetic particles dispersed uniformly in an amorphous ferromagnetic matrix, which matches well the description of an ideal exchange-spring magnet.

EXAMPLE II

Figure 20:
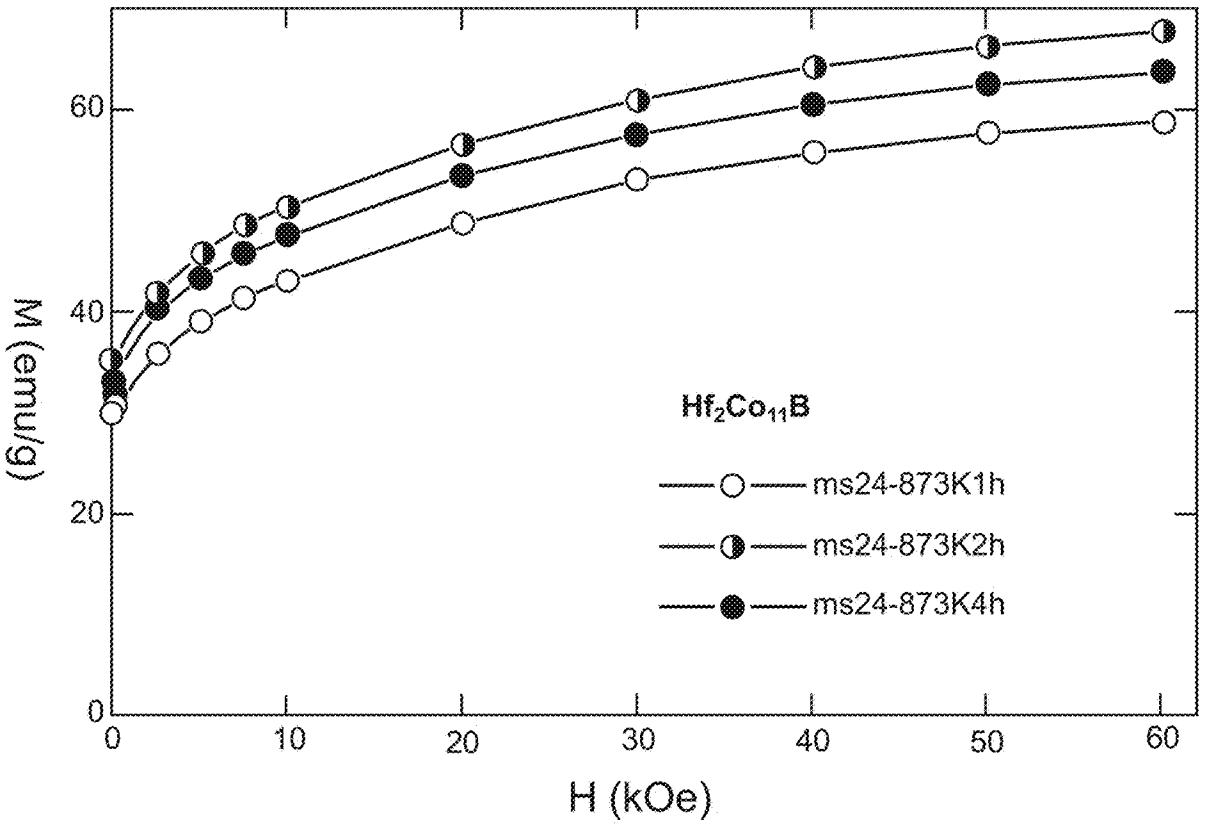
FIG. 20 is a graph showing magnetic moments per gram for MS24-soft $Hf_2Co_{11}B$ ribbons measured at room temperature after annealing at 873K (600° C.) for 1, 2, and 4 hours.
Figure 21:
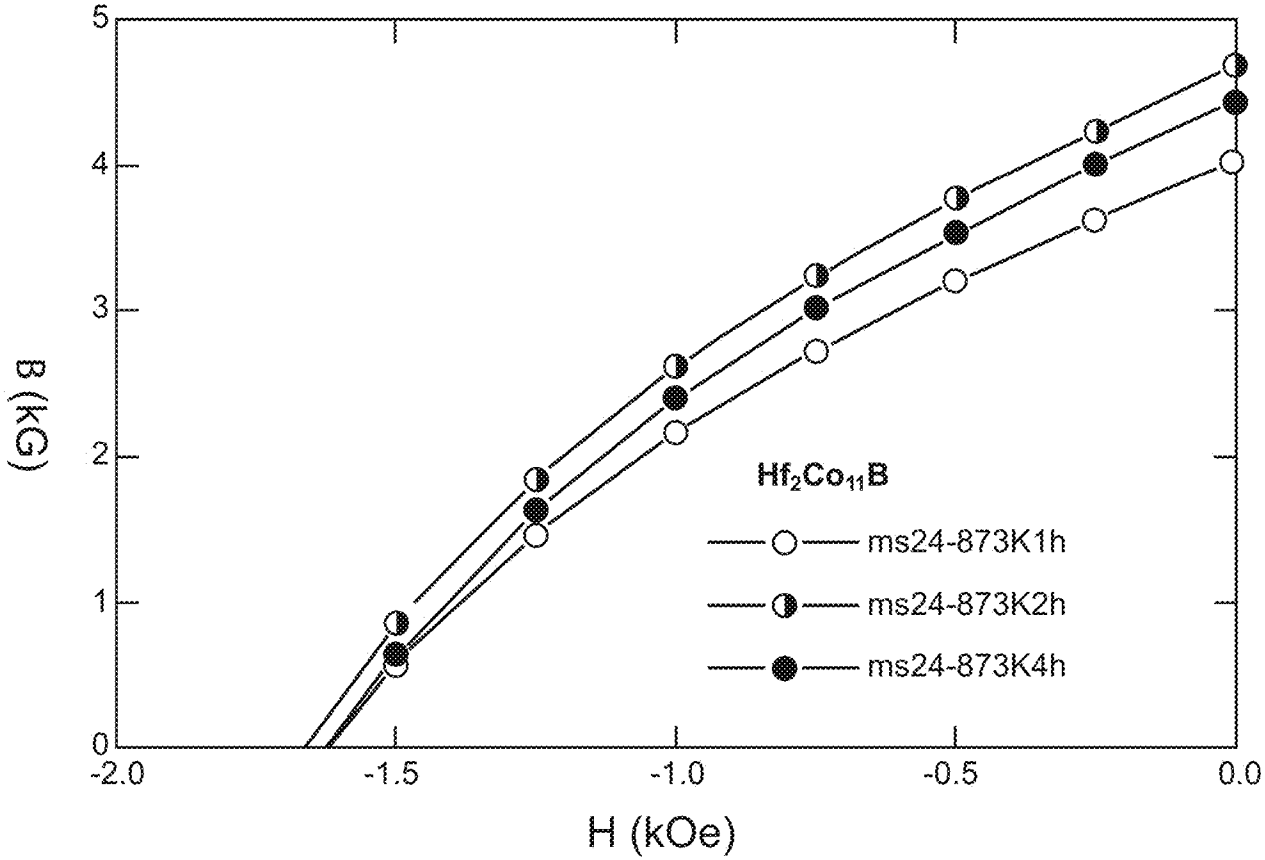
FIG. 21 is a graph showing demagnetization curves (magnetic induction vs. applied field) for MS24-soft $Hf_2Co_{11}B$ ribbons measured at room temperature after annealing at 873K for 1, 2, and 4 hours.
Figure 22:
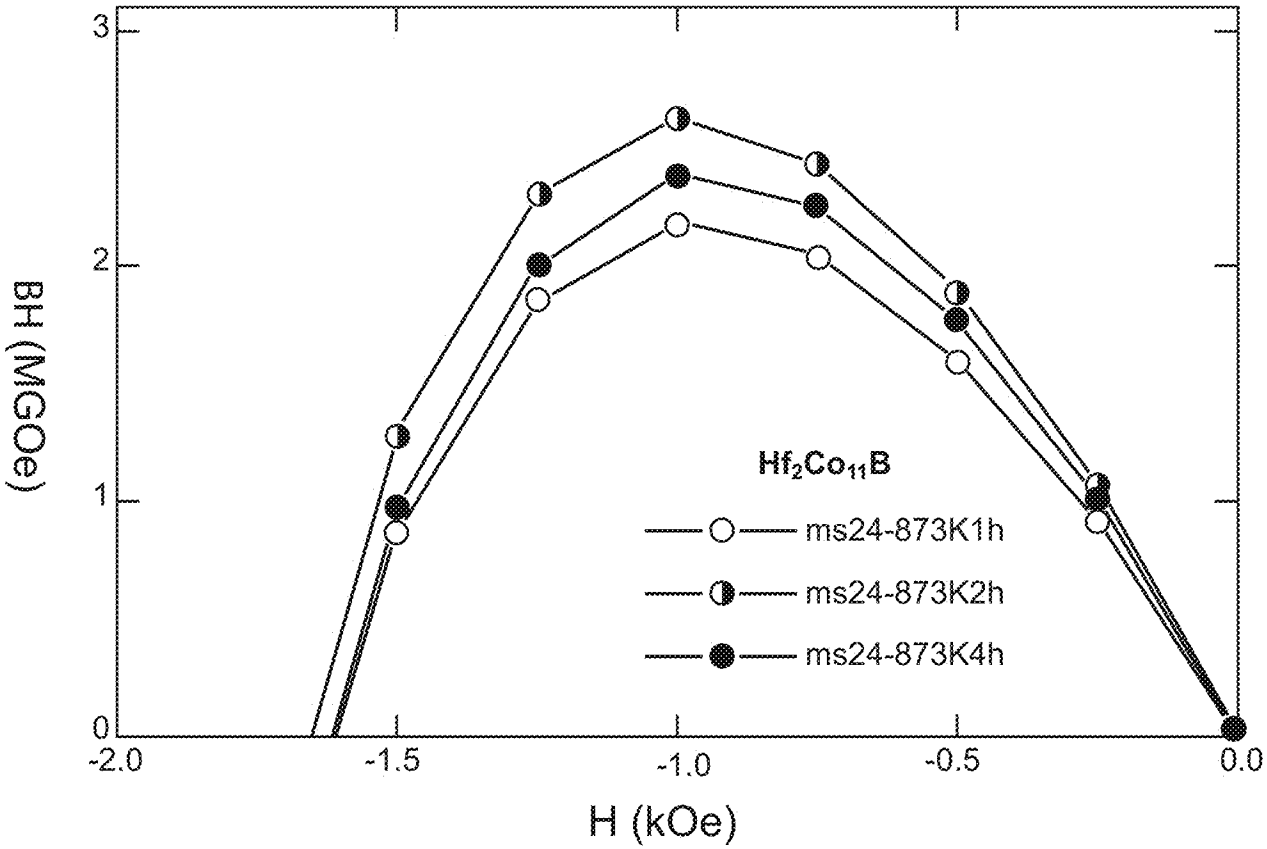
FIG. 22 is a graph showing magnetic energy products of MS24-soft $Hf_2Co_{11}B$ ribbons measured at room temperature after annealing at 873K for 1, 2, and 4 hours.
Figure 23:
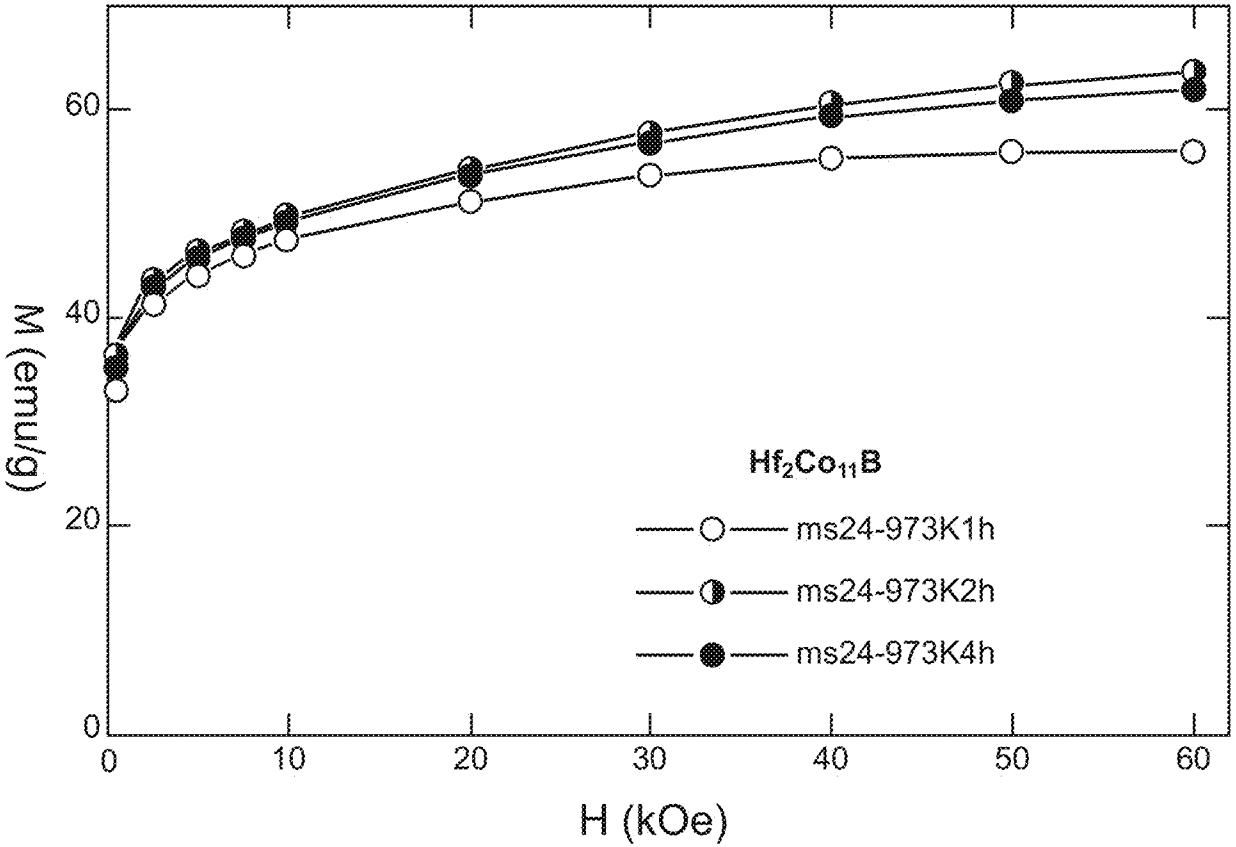
FIG. 23 is a graph showing magnetic moments per gram of MS24-soft $Hf_2Co_{11}B$ ribbons measured at room temperature after annealing at 973K (700° C.) for 1, 2, and 4 hours.
Figure 24:
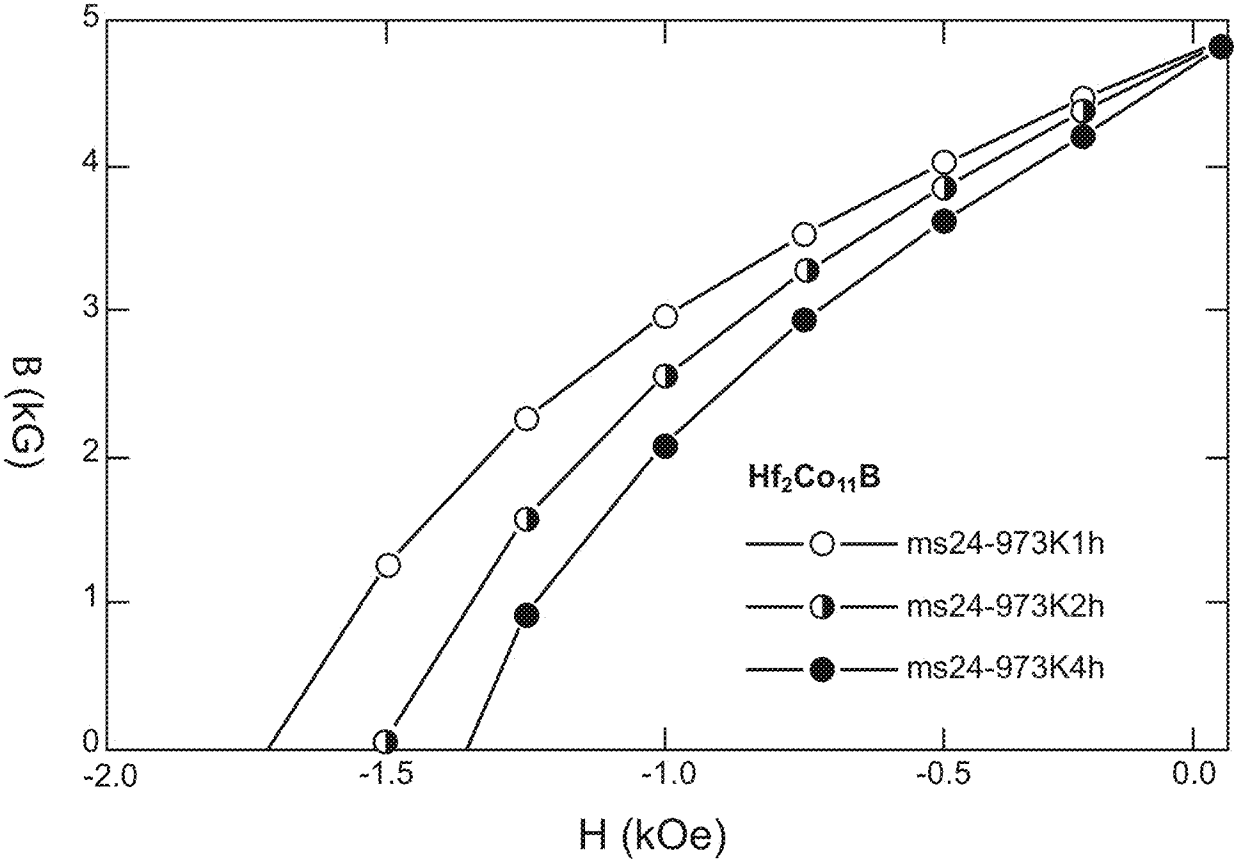
FIG. 24 is a graph showing demagnetization curves (magnetic induction vs. applied field) for MS24-soft $Hf_2Co_{11}B$ ribbons measured at room temperature after annealing at 973K for 1, 2, and 4 hours.
Figure 25:
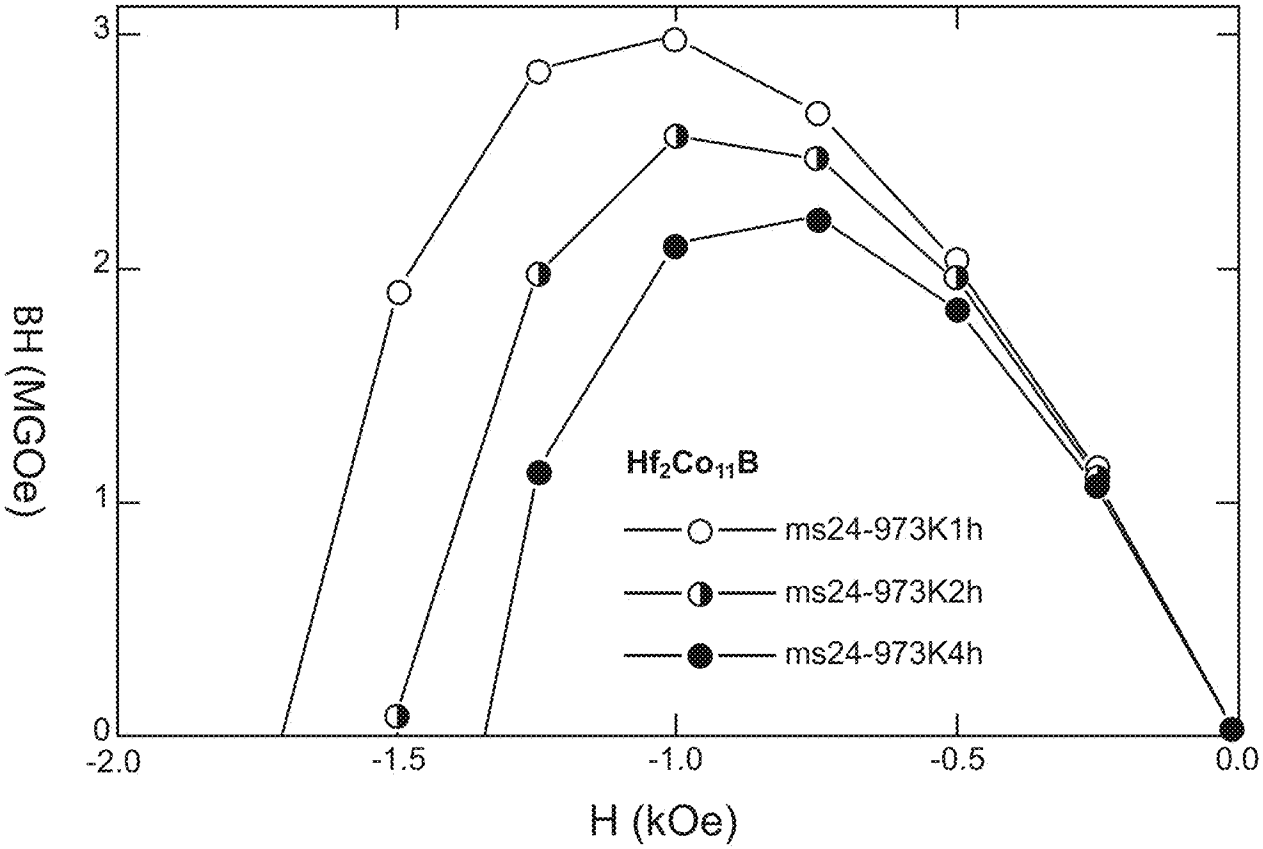
FIG. 25 is a graph showing magnetic energy products of MS24-soft $Hf_2Co_{11}B$ ribbons measured at room temperature after annealing at 973K for 1, 2, and 4 hours.

Amorphous $Hf_2Co_{11}B$ ribbons were produced by melt spinning with a wheel speed of 24 m/s. FIG. 20 demonstrates the effects of annealing for 1, 2 and 4 hours at 873K (600° C.) on the saturation moment. FIG. 21 shows the demagnetization curves and FIG. 22 shows the energy product thereof. FIGS. 23-25 demonstrate respective effects when the annealing temperature is raised to 973K (700° C.). The starting material is a soft ferromagnet having remanent magnetic induction of 1.1 kG and coercive field of less than 10 Oe.

As shown in FIGS. 20-25, heat treatment is an effective means of improving and tuning the magnetic properties of these materials. The applied processing results in hard ferromagnetism with remanent magnetic induction increased to more than 4 kG and intrinsic coercive fields greater than 1300 Oe. The results show that varying the time of processing at 873K affects mainly the remanence (y-intercept in FIG. 23) with little effect on the coercivity (x-intercept in FIG. 23) while varying the time of processing at 973K affects mainly the coercivity (x-intercept in FIG. 24) with little effect on the remanence (y-intercept in FIG. 24). When processed at 873K, the saturation moment (FIG. 1*a*) and the energy product (FIG. 22) are maximum for intermediate processing times, and lower for longer or shorter times. When processed at 973K, these two properties are maximum for the shortest times investigated. Further improvements are expected with more rapid processing.

Figure 26:
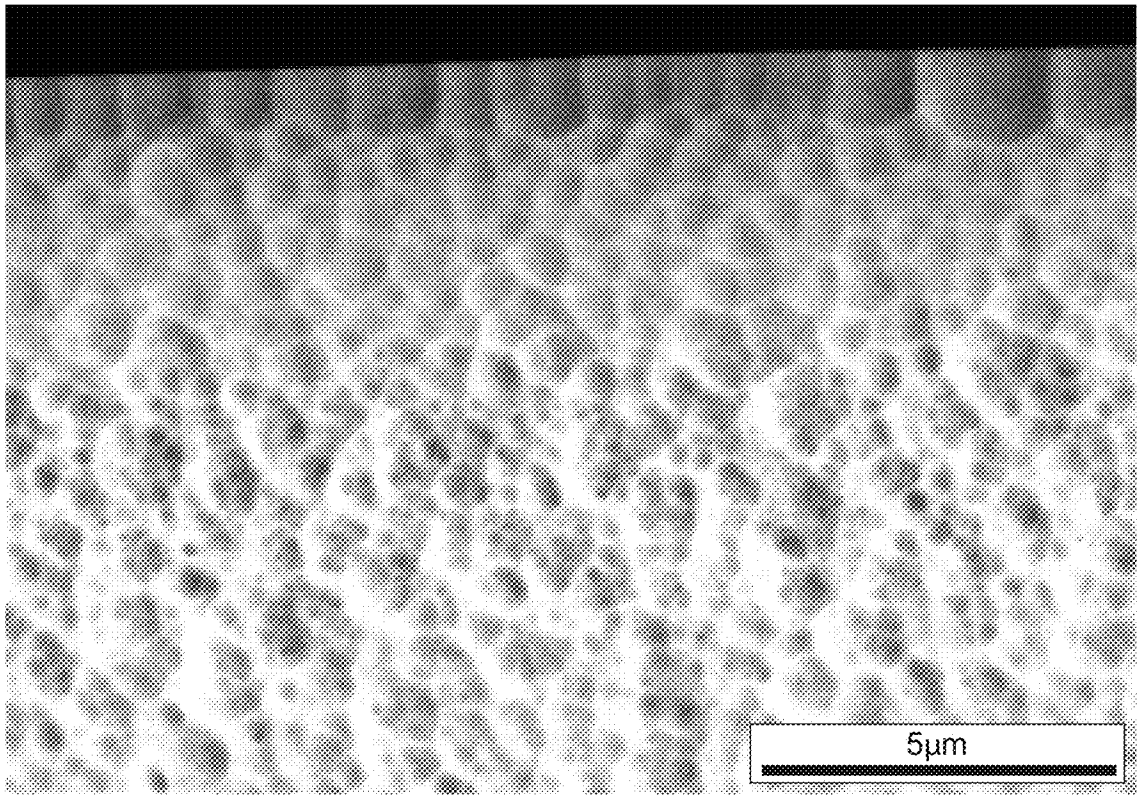
FIG. 26 is a scanning electron micrograph (secondary electron image) of a polished and etched sample of MS24-soft $Hf_2Co_{11}B$ ribbon for comparison with the annealed material shown in FIG. 27. Dark/light contrast is associated with compositional variation.
Figure 27:
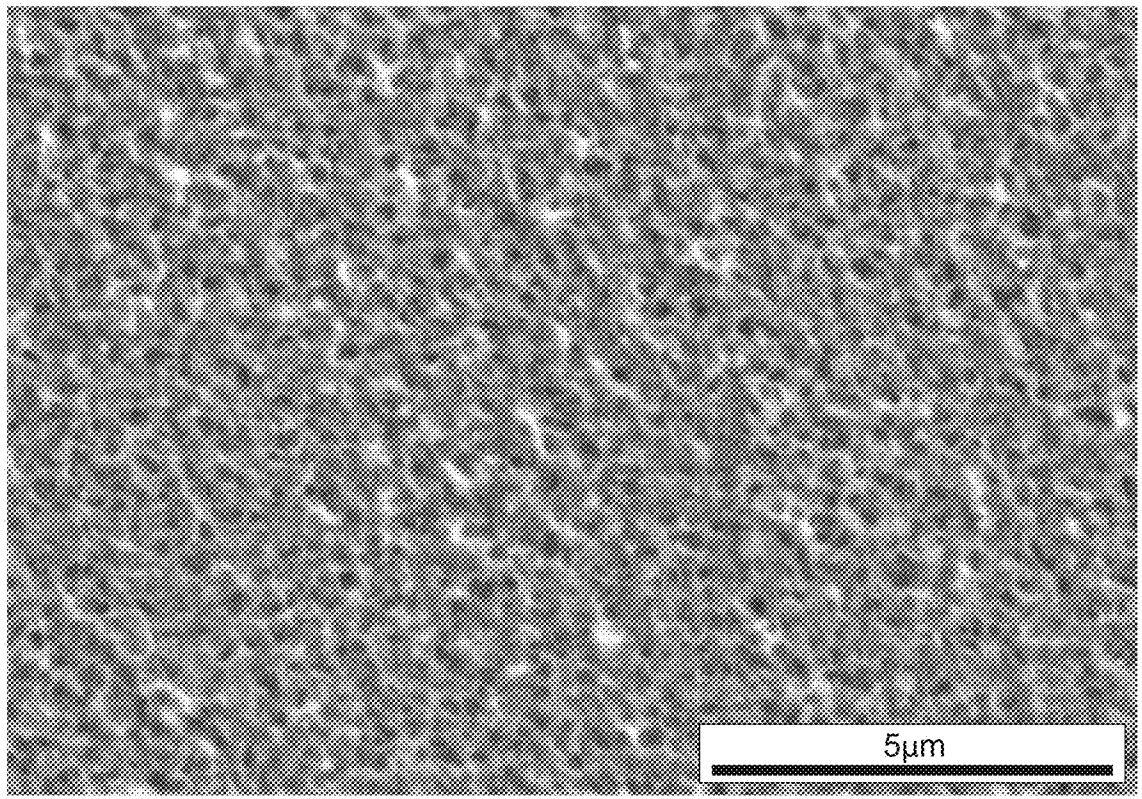
FIG. 27 is a scanning electron micrograph (secondary electron image) of a polished and etched sample of MS24-soft $Hf_2Co_{11}B$ ribbon after annealing at 873K for 2 hours. Nanoscale precipitates are observed.
Figure 28:
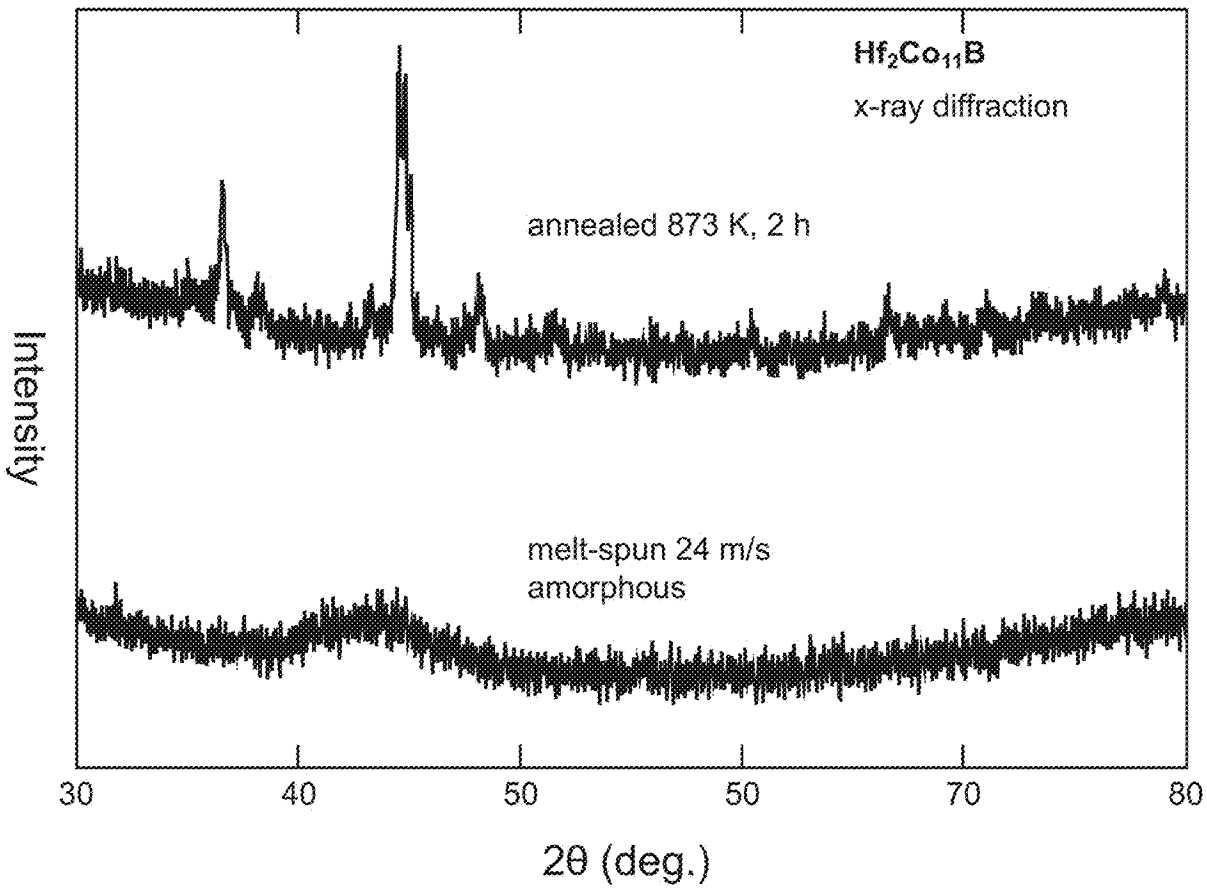
FIG. 28 is a graph showing X-ray diffraction patterns from surfaces of $Hf_2Co_{11}B$ ribbons. The lower pattern is from the amorphous material.

FIGS. 26, 27 compare the microstructure of the material before and after annealing (2 h at 873K in the image shown). The micrographs demonstrate that the development of nanoscale precipitates results from heat treatment, which is responsible for the harder magnetic properties of the annealed materials relative to the starting material. Importantly, the precipitates appear spherical, and are crystalline, as indicated by the x-ray diffraction results shown in FIG. 28. The upper pattern shown in FIG. 28 is from the material annealed at 873K for 2 hours, and demonstrates that crystallization accompanies the formation of the nanoscale precipitates shown in FIG. 26.

The availability of an amorphous precursor material, and the demonstration of promising properties developed and tuned by simple heat treatments (annealing) provides a path to customized and optimized microstructures and associated magnetic properties.

Moreover, annealing within a magnetic field (as described hereinabove) is effective at controlling the morphology of the microstructure in these melt spun ribbons. Magnetic fields are used to control the microstructural evolution by enhancing certain growth directions. However, magnetic fields can also produce microstructures having varying degrees of anisotropy. This leads to the development of an anisotropic microstructure and subsequent magnetic properties.

EXAMPLE III

Figure 29:
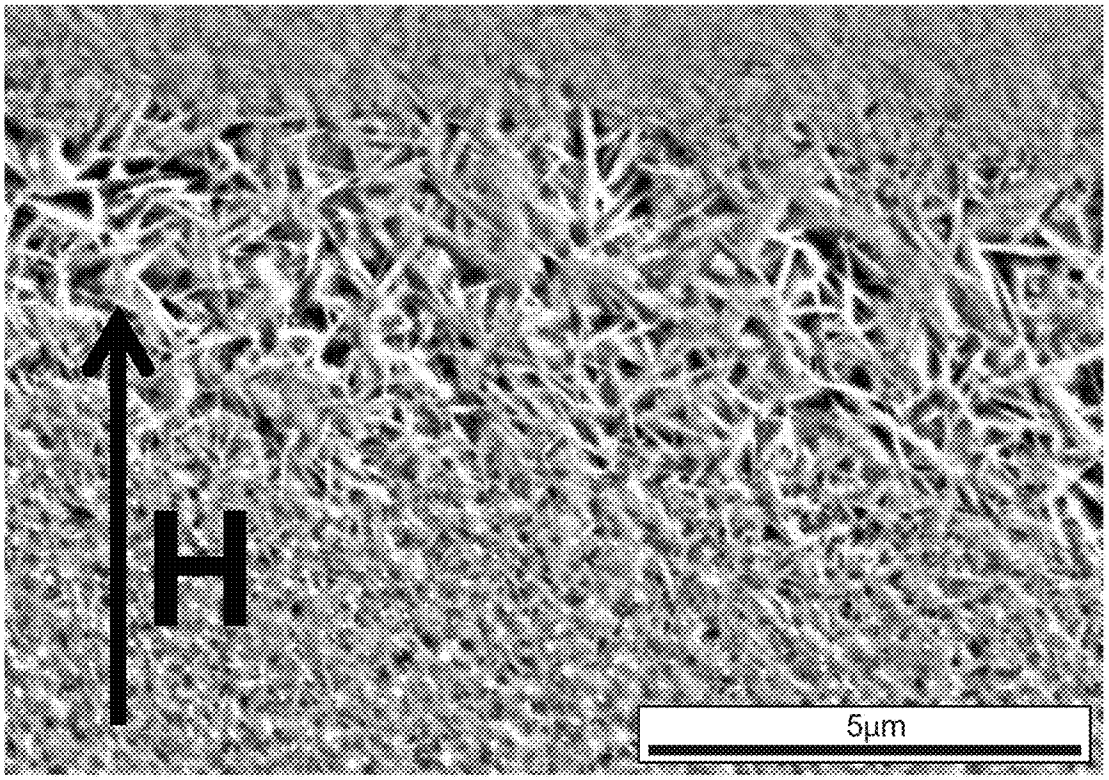
FIG. 29 is a scanning electron micrograph (secondary electron image) of a polished and etched sample of $Hf_2Co_{11}B$ ribbon after annealing at 873K for 2 hours within a 9 Tesla magnetic field applied along the shortest dimension of the ribbon as indicated by the arrow.
Figure 30:
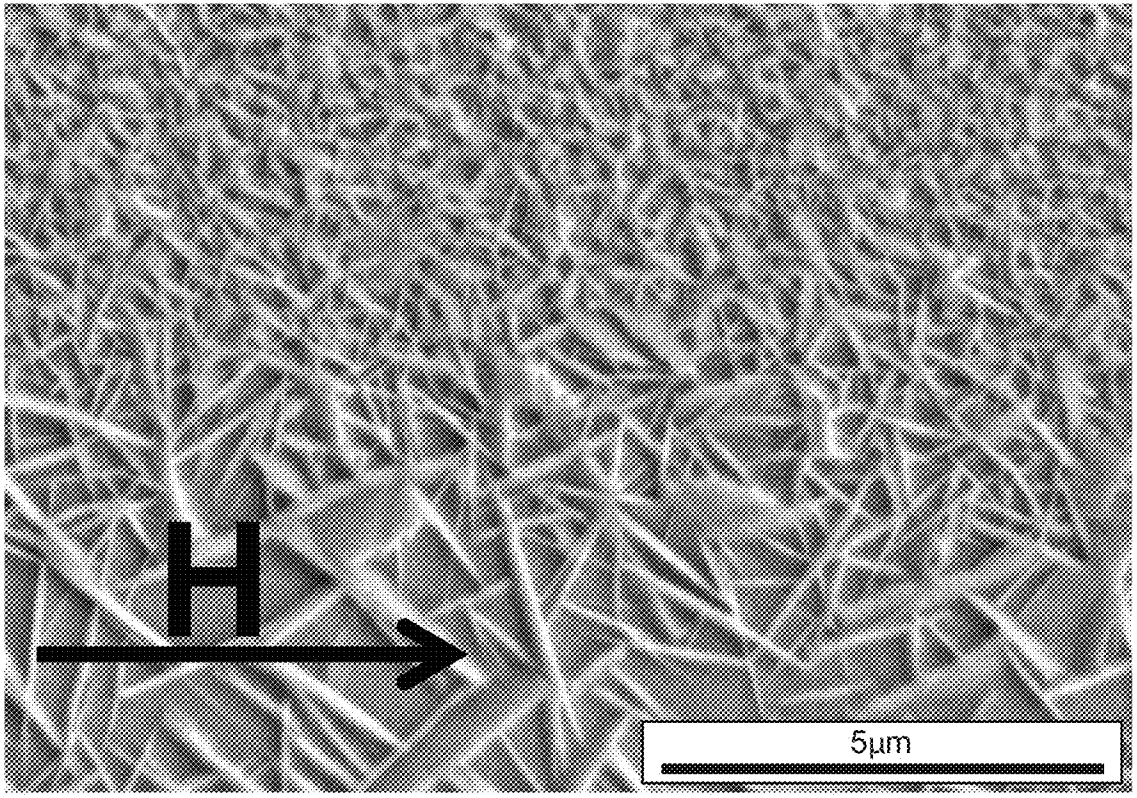
FIG. 30 is a scanning electron micrograph (secondary electron image) of a polished and etched sample of $Hf_2Co_{11}B$ ribbon after annealing at 873K for 2 hours within a 9 Tesla magnetic field applied along the longest dimension of the ribbon as indicated by the arrow.

FIGS. 29, 30 show micrographs from material processed at 873K for 2 hours within a magnetic field of 9 T. Comparison with FIG. 27 shows clear differences in microstructure induced by the field, and demonstrate the elongated morphology of the precipitates induced by the field. The magnetic field processed sample has precipitates that are non-spherical and not uniformly distributed through the sample.

Comparison between FIGS. 29 and 30 shows the dependence of the developed microstructure on the direction of the applied field, indicated by the arrows in the figure. This demonstrates anisotropic properties developed during heat treatment of the materials in a magnetic field. These results show that microstructural tuning is achievable by combining heat and magnetic field processing.

The methods and materials described hereinabove can be extended to Hf/Zr—Co—B alloys to make suitable materials for rare-earth free permanent magnets.

Zirconium has been substituted for Hf to form alloys of composition $Hf_{2-X}Zr_XCo_{11}B_Y$ wherein $0<X<2$ and $0<Y\leq1.5$. Nanoscale crystalline structures displaying hard ferromagnetism (coercivity in excess of 1000 Oe) can be produced from the alloys containing both Hf and Zr by melt-spinning and in-situ or ex-situ thermal annealing either with or without an applied magnetic field as described hereinabove for those containing Hf with no Zr.

EXAMPLE IV $Hf_{1.5}Zr_{0.5}Co_{11}B_{1.2}$ is melt-spun using a wheel speed of 16 m/s and a crucible orifice of 0.5 mm, resulting in a nanoscale crystalline structure which results in hard, ferromagnetic behavior.

While there has been shown and described what are at present considered to be examples of the invention, it will be obvious to those skilled in the art that various changes and modifications can be prepared therein without departing from the scope of the inventions defined by the appended claims.

What is claimed is:

1. A melt-spun, annealed alloy composition consisting essentially of melt-spun, annealed ferromagnetic $Hf_{2-X}Zr_XCo_{11}B_Y$, wherein $0 \leq X < 2$ and $0 < Y \leq 1.5$, said melt-spun, annealed alloy composition having a nanoscale crystalline structure comprising at least one non-equilibrium phase.

2. A melt-spun, annealed alloy composition in accordance with claim 1 wherein X=0.

3. A melt-spun, annealed alloy composition in accordance with claim 1 wherein X>0.

4. A melt-spun, annealed alloy composition in accordance with claim 1 wherein said melt-spun, annealed alloy composition is ferromagnetic at room temperature and has a saturation magnetic moment of at least 50 emu/g.

5. A melt-spun, annealed alloy composition in accordance with claim 4 wherein said magnetic moment of at least 50 emu/g is persistent to a temperature of at least 100° C.

6. A method of making the melt-spun, annealed alloy of claim 1 comprising the steps of:

a. Forming an essentially, macroscopically homogeneous alloy consisting essentially of $H_{2-X}Zr_XCo_{11}B_Y$, wherein $0 \leq X < 2$ and $0 < Y \leq 1.5$;

b. melt-spinning the alloy to form a ribbon having at least one microstructure selected from the group consisting of an amorphous phase and a nanoscale crystalline phase;

c. annealing the melt-spun alloy ex-situ to form a nanoscale crystalline structure therein.

7. A method of making a magnetic alloy in accordance with claim 6 wherein O<X<2.

8. A method of making a magnetic alloy in accordance with claim 6 wherein said annealing step is carried out within a magnetic field of least 1 Tesla to form an at least partially anisotropic microstructure therein.

9. A method of making the melt-spun, annealed alloy of claim 1 comprising the steps of:

a. Forming an essentially, macroscopically homogeneous alloy consisting essentially of $H_{2-X}Zr_XCo_{11}B_Y$, wherein $0 \leq X < 2$ and $0 < Y \leq 1.5$;

b. melt-spinning and in-situ annealing the alloy to form a melt-spun alloy having a nanoscale crystalline structure therein.

10. A method of making a magnetic alloy in accordance with claim 9 wherein 0<X<2.

11. A method of making a magnetic alloy in accordance with claim 9 further comprising an annealing step comprising annealing the melt-spun alloy within a magnetic field of least 1 Tesla to form an at least partially anisotropic microstructure therein.

* * * * *